US008568062B2

(12) United States Patent
Stööd et al.

(10) Patent No.: US 8,568,062 B2
(45) Date of Patent: Oct. 29, 2013

(54) SAFETY DEVICE AND METHOD FOR SCUBA-DIVING

(75) Inventors: Jan Stööd, Hammarö (SE); Ola Patriksson, Karlstad (SE)

(73) Assignee: Consensum AS, Honefoss (NO)

( * ) Notice: Subject to any disclaimer, the term of this patent is extended or adjusted under 35 U.S.C. 154(b) by 841 days.

(21) Appl. No.: 12/598,972

(22) PCT Filed: May 8, 2008

(86) PCT No.: PCT/SE2008/050532
§ 371 (c)(1),
(2), (4) Date: Mar. 24, 2010

(87) PCT Pub. No.: WO2008/143581
PCT Pub. Date: Nov. 27, 2008

(65) Prior Publication Data

US 2010/0183373 A1 Jul. 22, 2010

(30) Foreign Application Priority Data

May 18, 2007 (SE) ..... 0701214

(51) Int. Cl.
*B63C 11/22* (2006.01)

(52) U.S. Cl.
USPC ..... 405/186

(58) Field of Classification Search
USPC ..... 405/185, 186
See application file for complete search history.

(56) References Cited

U.S. PATENT DOCUMENTS 1,167,930 A * 1/1916 Rasmussen ..... 441/111
1,704,368 A * 3/1929 Murphy ..... 441/102

(Continued)

FOREIGN PATENT DOCUMENTS

EP 0034569 A2 8/1981
EP 0853037 A2 7/1998

(Continued)

OTHER PUBLICATIONS

International Search Report and Written Opinion issued in parent PCT Application, Oct. 28, 2011.

*Primary Examiner* — Tara M. Pinnock
(74) *Attorney, Agent, or Firm* — Jeffrey S. Melcher; Manelli Selter PLLC

(57) ABSTRACT

The present invention relates to a safety method in connection with SCUBA diving to control a diver's buoyancy, in which method the diver (11) is equipped with diving equipment comprising at least one air pressure tank (1), a valve device (2) connected to the pressure tank (1) and arranged to supply air from said pressure tank via first supply means (5) to a breathing regulator (4) and via second supply means (7, 9, 12) to an inflatable diving jacket (6) in order to control the diver's buoyancy, an actuator (8) being able to automatically initiate inflation of the diving jacket (6) when the diver has not affected the air flow through the breathing regulator (4) for a certain time period, said actuator (8) being controlled by an actuation mechanism (20) that automatically sets the actuator in active mode when the diver is within an actuation zone (A), wherein in order additionally to improve the diver's buoyancy the actuator (8) is also arranged to automatically initiate dumping of a weight (11) carried by the diver when the air flow through the breathing regulator (4) has ceased for a certain time period. The invention also comprises a safety device, an inflatable diving jacket and an inflator.

13 Claims, 15 Drawing Sheets

(56) References Cited

U.S. PATENT DOCUMENTS

| | | | | | |
|---|---|---|---|---|---|
| 2,331,301 | A | * | 10/1943 | Brown | 441/111 |
| 3,228,080 | A | | 1/1966 | Trauger | |
| 3,540,067 | A | * | 11/1970 | Deruaz | 441/117 |
| 3,939,511 | A | * | 2/1976 | Buttenschon | 441/118 |
| 4,051,846 | A | | 10/1977 | McClure, III | |
| 4,108,171 | A | | 8/1978 | Nyman | |
| 4,167,051 | A | * | 9/1979 | Galecke | 441/117 |
| 4,176,418 | A | | 12/1979 | Scott | |
| 5,560,738 | A | | 10/1996 | Noel | |
| 5,746,543 | A | | 5/1998 | Leonard | |
| 6,447,353 | B1 | * | 9/2002 | Henry | 441/106 |
| 6,551,161 | B2 | * | 4/2003 | Chern et al. | 441/124 |
| 6,666,623 | B1 | | 12/2003 | Greene | |
| 7,201,626 | B1 | * | 4/2007 | Nelson et al. | 441/106 |
| 7,288,011 | B2 | * | 10/2007 | Ganley | 441/106 |

FOREIGN PATENT DOCUMENTS

| | | | |
|---|---|---|---|
| EP | 1283161 | A2 | 2/2003 |
| FR | 2741853 | A1 | 12/1995 |
| WO | 2006112835 | A1 | 10/2006 |
| WO | 2007058615 | A1 | 5/2007 |

* cited by examiner

SAFETY DEVICE AND METHOD FOR SCUBA-DIVING

CROSS-REFERENCE TO RELATED APPLICATIONS

This application is a national stage entry under 35 U.S.C. 371 of International Application No. PCT/SE2008/050532, filed 8 May 2008, designating the United States. This application claims foreign priority under 35 U.S.C. 119 and 365 to Swedish Patent Application No. 0701214-9, filed 18 May 2007.

TECHNICAL FIELD

The present invention relates to a safety device, diving equipment and a safety method in connection with SCUBA diving in order to control a diver's buoyancy, wherein the diver is equipped with diving equipment comprising at least one air pressure tank, a valve device connected to the pressure tank and arranged to supply air from said pressure tank via first supply means to a breathing regulator and via second supply means to an inflatable diving jacket in order to control the diver's buoyancy, an actuator being able to automatically initiate inflation of the diving jacket when the diver has not affected the air flow through the breathing regulator for a certain time period, wherein said actuator is controlled by an actuation mechanism that automatically sets the actuator in active mode when the diver is within an actuation zone. The invention also comprises an inflatable diving jacket comprising a weight pocket system. Moreover, the invention relates to a device for controlling a diver's buoyancy. The invention also relates to an inflatable diving jacket based on modules and comprising a compact pressure tank package and an inflator.

PRIOR ART

In skin diving with dive tanks, so called SCUBA diving (Self Contained Underwater Breathing Apparatus), the diver is provided with air from pressure tanks that he carries with him during the dive. For obvious reasons it is extremely important that the diving takes place in an appropriate way in order for accidents not to occur. Most persons that plan to dive choose to participate in training before starting to dive for real. Throughout the years, many appliances have been developed in order to prevent accidents in connection with diving. One example is the inflatable diving jacket carried by the diver, which helps him to control buoyancy and which is used in combination with weights in order to help the diver to descend. Examples of other appliances are tables and portable dive computers that help the divers to plan diving in order not to risk the bends or having to surface quickly because air is running out e.g. The diving equipment itself has also been developed and has been provided with devices that aim to prevent accidents. Most of these devices have the object of detecting any problems arising or to facilitate for the diver during a dive. Existing equipment, not least existing diving jackets, however suffer from drawbacks that may result in safety risks and/or do not adequately motivate the diver to improve the safety aspect of his or her diving equipment.

One situation that quite frequently results in near-accidents and sometimes in drowning is when the diver for some reason is suffering from stress as he surfaces. A standard protocol is that when the diver surfaces he should first make sure of his own buoyancy by air filling the diving jacket before removing the breathing regulator from the mouth. If a diver in that situation does not succeed in making sure of his own buoyancy by air filling the diving jacket, he will soon begin to sink due to the weight of the diving equipment. For this reason, accidents have occurred in which people have drowned despite diving in water with a depth of no more than two metres.

Safety devices are previously known in connection with diving equipment, with the purpose of improving the safety aspects in respect of the latter mentioned drawbacks. From FR 2741853 it is e.g. known such a device that comprises sensors in combination with actuation means in order, in connection with certain predetermined conditions, to initiate inflation of a diving jacket in order to eliminate situations of potential drowning. A device is further known from EP 034569, having a system that is intended to automatically inflate a life jacket upon cessation of breathing. A safety system is furthermore known from U.S. Pat. No. 4,176,418, which is intended to result in automatic inflation of a diving jacket upon cessation of breathing. In U.S. Pat. No. 5,746,543 it is further shown a device that stated to aid the diver in automatic control of buoyancy. Also U.S. Pat. No. 6,666,623 shows a similar device. In U.S. Pat. No. 5,560,738 it is further shown yet a variant of a safety device in connection with diving. According to this device there is provided equipment to control that a diver is not at a depth for which he doesn't have enough air left in the pressure tank. In the event that the device detects that the pressure tank does not contain enough air, the device will automatically inflate the diver's jacket such that the diver will ascend. The device can also be set to achieve an automated ascent up to surface if the diver descends to a predetermined maximum depth. None of these known devices can however be considered to satisfactorily solve the problem.

As to another safety aspect, the diver is trained to increase his buoyancy in an emergency situation by releasing the weights carried in a separate weight belt or in pockets at the front of and at the lower edge of the diving jacket. Therefore, weight belts and diving jackets are provided with buckles that are intended to be released by a simple hand manoeuvre in order for the weights to be quickly released, see for example Mares' diving jacket of model Dragon, which can be seen on Mares' website www.mares.com. Despite the efforts undertaken to facilitate the releasing of weights, it has been observed that only a few percent of divers killed have released the weights. The major reason for this is most likely that the diver acts irrationally in an emergency situation and in fact does not even try to release his weights. A diving buddy that attempts to release the weights will also face a very large risk due to the positioning of the weights.

BRIEF ACCOUNT OF THE INVENTION

It is an object of the present invention to provide an improved safety method in connection with SCUBA diving. This is achieved by initiating inflation of the diving jacket and dumping of the weights in the diving jacket, if the diver has not affected the flow of air through the breathing regulator for a certain predefined time. The invention also relates to a safety device for achieving this safety method. The invention also comprises a diving jacket that comprises a system of weight pockets that can be automatically released when the safety device is affected, and weights adapted to achieve this function. The invention also relates to an inflatable diving jacket based on modules and comprising a compact pressure tank package and an inflator.

Thanks to the invention, a diver that would otherwise risk drowning will be safely brought up to the water surface. By the method being based on sensing whether the diver breathes in his breathing regulator, the safety device can be arranged to initiate inflation of the diving jacket in situations in which normal safety systems would not detect the emergency, for example if the diver is apparently under control close to the water surface but without breathing in his breathing regulator (for a certain predefined time), which could for example be the case due to heart problems. Furthermore, the safety device can be arranged to initiate dumping of the weights of the diving jacket according to the invention, in order additionally to improve the diver's buoyancy, which together with the automatic inflation of the diving jacket will result in a synergistic effect.

In a preferred embodiment, the safety device is operated by air from the pressure tank, which means that the safety device will have high reliability. A preferred device according to the invention is also characterised in that it is affected only by a few components that are suitably known per se at the market, whereby product costs can be kept down. According to a preferred embodiment, the safety device is easy to connect to existing diving equipment or it can be integrated in new equipment, for example in connection with the pressure tank at the jacket or integrated in a dive computer. Thereby, safety in connection with SCUBA diving can be considerably improved in a flexible way and at a relatively reasonable cost. By being able to use the invention in principle in combination with existing equipment independent of the make, a diver may continue to use the equipment that he is most comfortable with, resulting in additional synergy in respect of safety. There may however result an additional function of the safety device if it is combined with a diving jacket according to the invention, which is arranged to allow for automatic dumping of the weights that the diver carries with him in order to descend. This function constitutes an essential part of the inventive idea and in the following description such a diving jacket has been used in order fully to exemplify the function of the safety device. It is however clear from the description that a number of combinations are possible of the safety device, parts of the inventive equipment and existing equipment, whereby the diver will be able to upgrade his equipment step by step.

In order not to risk injuries due to rapid ascent from a large depth to the water surface, the method is primarily intended to initiate inflation of the diving jacket and dumping of the weights when the diver is (or recently has been) in a position close to the water surface. This is suitably achieved by providing the diving equipment with an actuator that initiates inflation of the diving jacket and dumping of the weights when the diver is in an actuation zone just below the water surface. Such a device is known from e.g. the applicant's patent application no. PCT/SE2006/050493. A reference to that document is hereby introduced.

According to yet another aspect of the invention, the actuator is preferably actuated if the diver is within an actuation zone A that is limited by an upper predefined actuation depth D1 and a lower predefined actuation depth D2. Hereby, the advantage is also attained that the jacket is prevented from being inflated if the diver is at a depth from which a direct ascent to surface is not desirable/suitable. For that reason, the upper predefined actuation depth suitably corresponds to a depth of between immediately below the water surface to a depth of 1 m, preferably 0.1-0.5 m, more preferred 0.1-0.3 m, most preferred about 0.2 m below water surface, and the lower predefined actuation depth corresponds to a depth chosen in consideration to preferences, e.g. a depth immediately above the usual depth for so called safety stops in connection with ascendance to surface, preferably 2-5 m, more preferred 3 m, most preferred about 2.5 m below water surface.

By the actuator preferably comprising a pressure sensing means that detects the diver's depth D, the advantage is attained that as soon as the diver enters the actuation zone the safety system is automatically activated at the same time the system prevents inflation of the diving jacket and dumping of weights when the diver is at a depth from which a rapid ascent to surface would be a serious health hazard. Whether the diver enters the actuation zone on his way down or on his way up to the surface is of no importance in this connection. By all components of the safety device only requiring pressurized air for operation, which pressurized air is always available from the pressure tank, a very reliable safety method can be provided. Of course the actuation zone can be adapted as desired and in dependence of how the diving in question is to take place.

Additional aspects of the invention are clear from the additional dependent claims and from the description.

In addition to this, the safety method, the safety device and the diving jacket according to the invention should also contribute to the achievement of one, some or preferably most of the objects listed below:

- the safety device can be installed on existing diving equipment,
- the safety device can be moved from one set of diving equipment to another,
- the safety device should have high reliability,
- the safety device can offer manual inflation of the diving jacket and dumping of the weights in connection with a near-accident,
- a sole diver can be given better safety against diving related accidents,
- manual setting of the actuation zone depth,
- when diving in shallow water (not more than 3-5 m), in connection with training e.g., the safety system can be continuously active, which will lead to improved safety for inexperienced divers,
- manual actuation of the safety system can be offered, which could be an advantage in connection with training in which the safety system can be actuated already on land for training purposes as well as from a safety point of view,
- actuation by remote control can be offered, e.g. in combination with a dive computer, wireless transmission/reception,
- the safety system can be connected to (or be integrated in) a dive computer.
- Improved ergonomics and diving properties in connection with the use of a new pressure tank,
- A cost efficient module design of a diving jacket, which allows for flexible exchanging/upgrading.

BRIEF DESCRIPTION OF THE DRAWINGS

In the following, the invention will be described in greater detail with reference to the attached drawing figures, of which.

DETAILED DESCRIPTION OF THE INVENTION

Figure 1B:
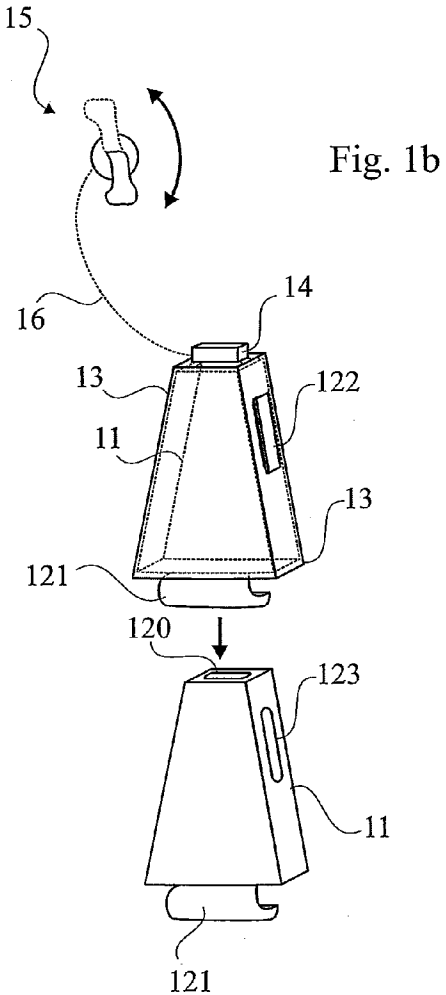
FIG. 1*a* schematically shows a set of diving equipment according to an embodiment of the invention, FIG. 1*b* schematically shows one embodiment of a pocket for a diving weight and a diving weight, FIG. 1*c* schematically shows a set of diving equipment according to yet an embodiment of the invention.
Figure 1A:
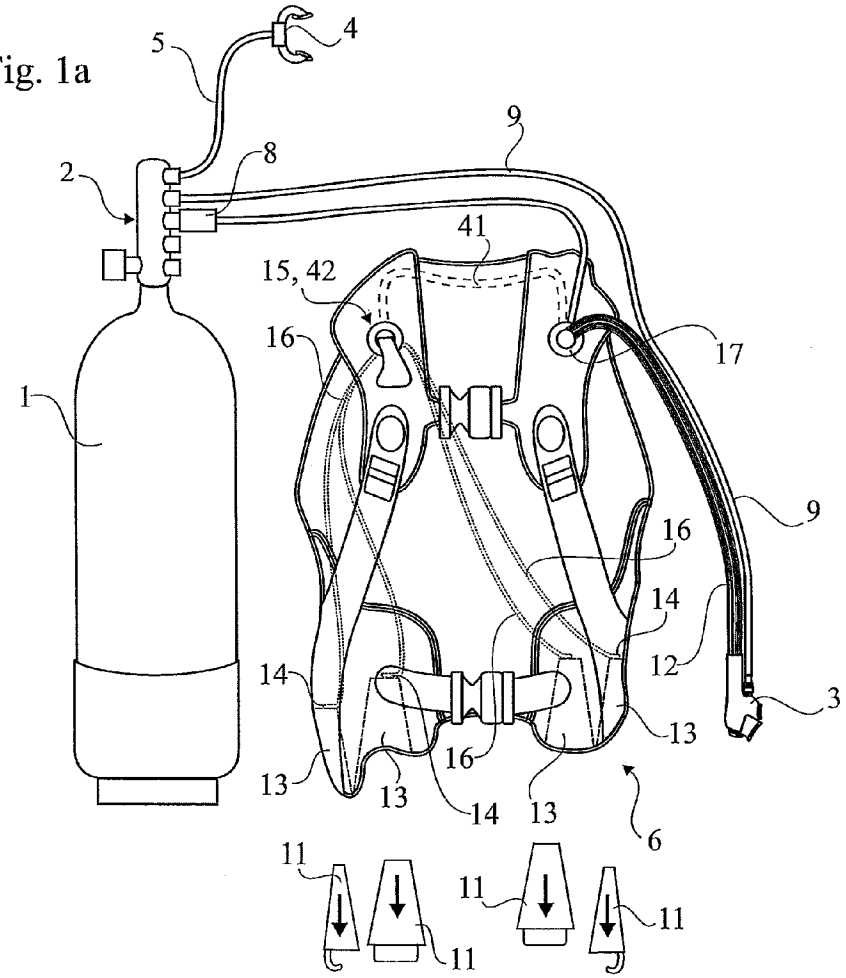

FIG. 1*a* shows a set of diving equipment used in connection with SCUBA diving. The equipment comprises at least one pressure tank 1, a valve device 2 connected to the pressure tank and arranged to supply air from said pressure tank via a first flexible tube to a breathing regulator 4. The valve device 2 is also arranged to lead air from the pressure tank to a so called diving jacket 6 and to a so called inflator 3 by aid of which the diver can manually inflate the diving jacket with air from the pressure tank 1, or alternatively release air from the diving jacket. The diving jacket 6, which is inflatable, is carried by the diver and it is used to control his buoyancy. In the shown embodiment, the diving jacket 6 is supplied with air via a second flexible tube 7 from the pressure tank. The inflator 3 is supplied with air from the pressure tank via a third flexible tube 9 that is connected to the pressure tank. A fourth flexible tube 12 connects the inflator 3 with the diving jacket 6, via a coupling device 17.

The diving jacket comprises pockets 13 for weights 11 that aid the diver to descend. The pockets are preferably positioned along the lower edges of the front side and the side of the diving jacket 6. The pockets comprise one holder 14 each, by aid of which the weights 11 can be retained in the pockets. The holders are connected, via a respective coupling mechanism 16, with a weight dumping device 15 that is arranged as a unit integral with the diving jacket. The weight dumping device, here indicated by a handle, comprises a release mechanism 42 that initiates the dumping of the weights. This part of the invention is applicable without connection with the other parts of the inventive concept. In other words, an inventive diving jacket 6 may offer a substantially facilitated manual dumping of the weights as compared with prior art diving jackets. Thereby, the chance of a diver in an emergency situation managing to dump the weights and thereby achieve improved buoyancy is improved. It is also realised that another person that comes to the diver's rescue will be able to assist the diver in dumping the weights in a manner that is substantially much easier, quicker and more safe to himself.

The pockets 13 are preferably rigid and suitably they have a slightly conical shape. Pockets are e.g. shown in the figure, which remind of a cowbell. The pockets are positioned with their mouths directed essentially straight down, whereby the weights may fall from the pockets with the smallest possible resistance. The weights as well as the pockets are preferably manufactured from a material that renders the friction them between as small as possible. Alternatively, they are surface treated or covered/dressed in such a material.

The figure shows pockets that have a principally vertical falling line. By falling line is intended the line along which the weights fall when the diver is in a vertical position. The invention is however not limited to diving jackets with pockets directed accordingly, but it is realised that the pockets can be directed with downwards inclination as long as the weights can fall by themselves from the pockets, i.e. under influence of their own weight only, even if the diver is not in a vertical position. One possible direction can e.g. be with a slight inclination downwards, forwards, which facilitates for the weights to fall down when the diver is swimming, which he often does with his body in an essentially horizontal plane. Thanks to the pockets being given a conical shape, such a direction of the pockets will mean that the weights can fall down by their own weight, even if the diver happens to lean somewhat backwards. Naturally, it is possible to combine pockets of different directions, whereby the pockets that are positioned along the side of the diving jacket e.g. can be given an essentially vertical falling line, while the pockets on the front side of the jacket are given a falling line that is directed with an inclination downwards, forwards.

The diving equipment further comprises an actuator 8 that is arranged to communicate with said valve device 2 in order to initiate inflation of the diving jacket 6. Suitably, the actuator 8 is arranged also to initiate dumping of the weights of the diving jacket, preferably at the same time as the inflation of the diving jacket is initiated. For this function, there is a connection 41 between the coupling device 17 and the release mechanism 42 that cooperates with the couplings 16. Suitably, the actuator 8 is connected with the valve device 2 such that the connection them between is flexible, e.g. in the form of an intermediate elastic tube means (not shown) that allows for a certain pliability with the purpose of preventing impacts or knocks from resulting in large forces on the connection. The valve device 2 is suitably of conventional type and normally comprises a reduction valve (not shown) that reduces the air pressure from the pressure tank 1 (normally about 20-30 MPa). On the outlet side, the valve device comprises a number of tube couplings to which the actuator, the diving jacket, the regulator, the inflator etc. can be connected and provided with air of lower pressure, normally 0.8-1.1 MPa. One essential aspect for this is that the outlet side of the valve device 2 comprises a continuous room that is connected with the tube couplings. Thereby, the devices that are connected to the valve device will be in open communication with each other.

FIG. 1*b* shows a pocket 13 and a weight 11. The pocket 13 comprises a holder 14 that is arranged to retain the weight in the pocket (schematically shown). The holder 14 is connected to a weight dumping device 15, here indicated by a handle that is arranged, via a release mechanism 42 (not shown) and a coupling mechanism 16, to affect the holder 14 to release the weight, which is indicated by an arrow. The weight 11 comprises an attachment 120 arranged to cooperate with the holder 14. The weights also comprise some type of handle 121 that facilitates insertion and withdrawal of the weights into/from the pockets. The holder 14 and the attachment 120 could for example consist of magnets that hold the weight by magnetic force. Other attachment devices (magnets) 122, 123 can be arranged at the sides of the pocket and the weight, respectively, which cooperate and give a supplementary retaining force that is however not enough by itself to retain the weight in the pocket. In the shown example, automatic dumping of the weights is achieved by separation of any of the magnet pairs, here the pair of magnets that consists of magnets with the reference number 14 and 80, respectively. It is realised that the above mentioned is but one example of a manner of retaining and releasing the weight, respectively, and that other manners of achieving the same function naturally are included in the invention.

Figure 1C:
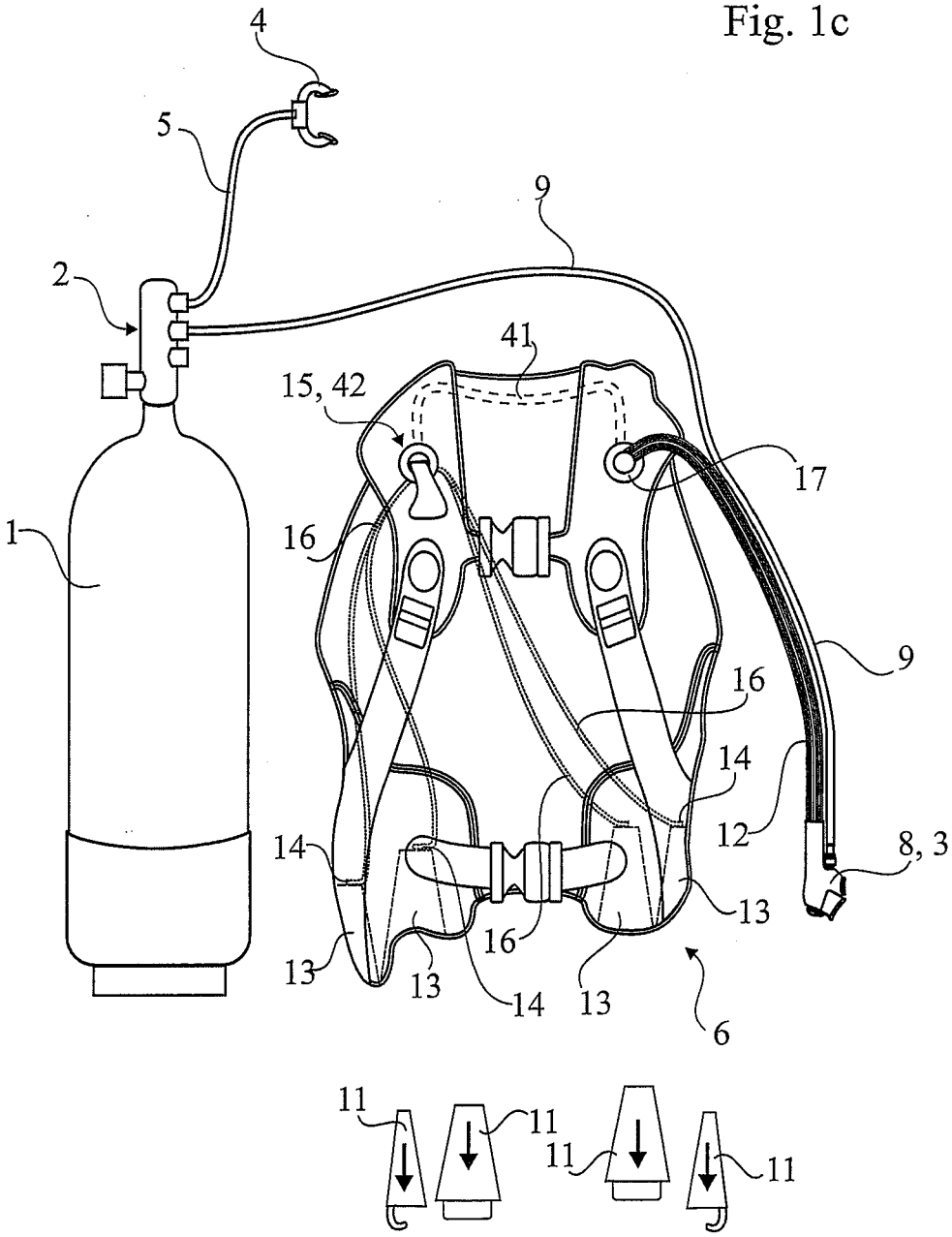

FIG. 1*c* shows a set of diving equipment with an actuator 8 according to the invention, which is integral with the inflator 3. In this embodiment, the second flexible tube 7 can be dispended with and instead the air from the pressure tank 1 is lead to the inflator 3 via a third flexible tube 9 that accordingly also will provide the actuator 8 with air. For the rest, the same parts are comprised as is shown in FIG. 1*a*, which is clear by the same type of comprised components having been given the same reference numbers.

Figure 2:
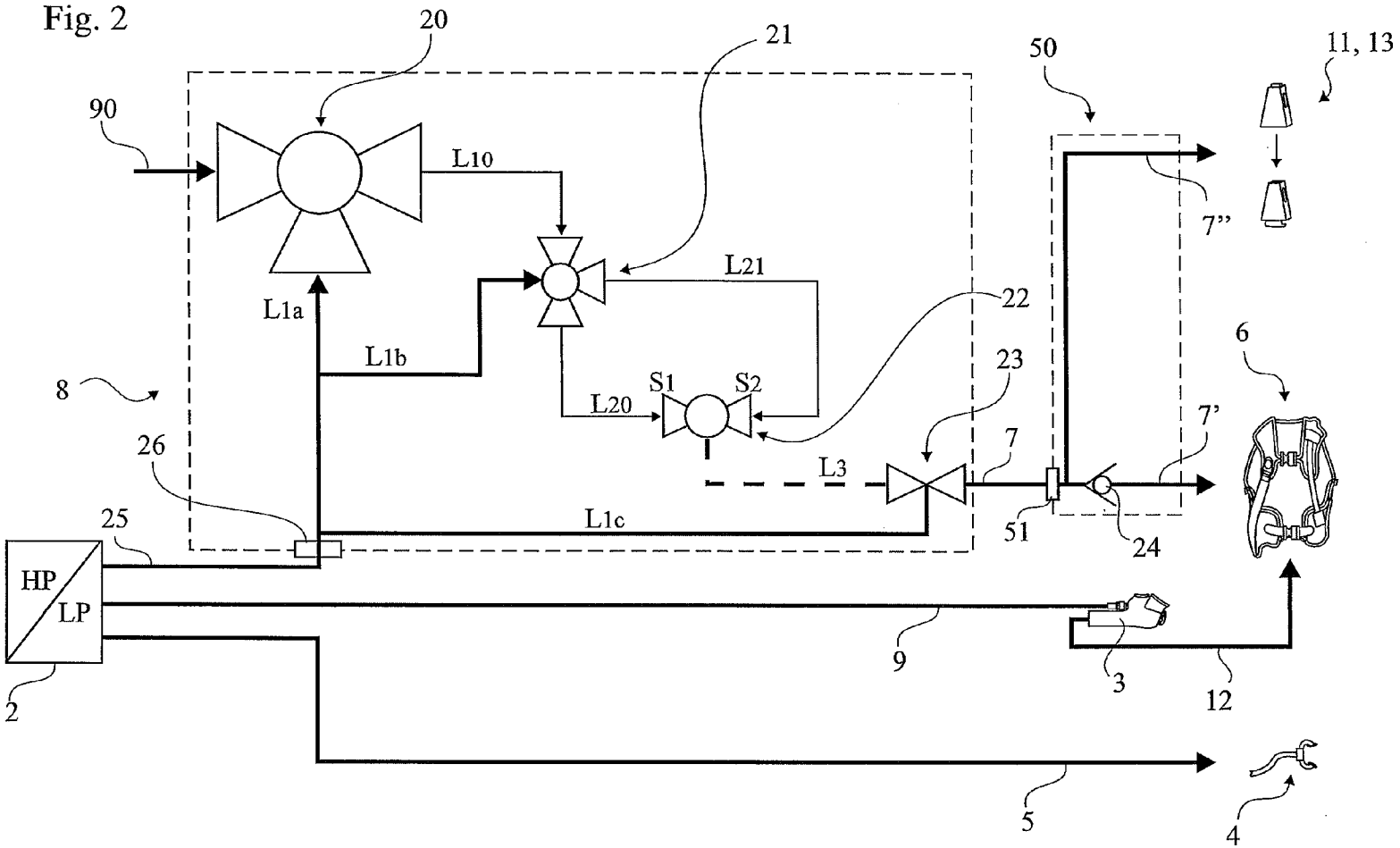
FIG. 2 shows a flowchart over an actuator according to the invention.

FIG. 2 shows a flowchart over an embodiment of the actuator 8 according to the invention and the components included therein. In this embodiment, the actuator 8 consists of a separate unit connected to the diving equipment in the manner shown in FIG. 1*a*. The actuator comprises a pressure sensing valve 20 that via a first connection L1*a* is in fluid communication with an outlet 25 from the valve device 2. Furthermore, the actuator 8 comprises a diaphragm valve 21 (or the like) that via a second connection L1*b* is in fluid communication with the outlet 25 from the valve device 2, and that via an outlet L10 is in fluid communication with the pressure sensing valve 20. In its turn, the diaphragm valve 21 is in connection with a delay means 22. There is a third connection L20 between the diaphragm valve 21 and a first side S1 of the delay means 22. There is a fourth connection L21 between the diaphragm valve 21 and a second side S2 of the delay means 22. In addition, the actuator 8 comprises a triggering valve 23 that via a sixth connection L3 is in fluid communication with the delay means 22. The triggering valve 23 is also in fluid communication with the outlet 25 from the valve device 2, via a seventh connection L1*c*, in order to be able to supply the diving jacket 6 with air from said second flexible tube 7.

In one embodiment according to the invention the pressure sensing valve 20 is constituted by a governor valve that operates between two end positions. The valve 20 is then closed in either end position, such that air cannot be conveyed through the valve 20 and into the conduit L10 to the diaphragm valve 21. Only in the case that a pressure from the surrounding water 200 affects the valve to make its pressure sensing means to indicate predetermined values, resulting in a position in between the above mentioned end positions, the pressure sensing valve 20 will open up the connection to supply air from the pressure tank 1, via the supply conduit L1*a* and further through its outlet L10 to the diaphragm valve 21.

The diaphragm valve 21 is a directional valve that guides the incoming air from the outlet L10 in the pressure sensing valve 20 (the air flow that comes in via the supply conduit L1*a*) to flow via said third connection L20 or said fourth connection L21. When the air pressure in L1*b* is static, which air pressure acts on the diaphragm valve 21, it will direct the air to flow out into said third connection L20. When there is a change in air pressure in the conduit L1*b* (which takes place in connection with an inhalation) the diaphragm moves inside the diaphragm valve 21, which in turn affects the direction of the flow through the diaphragm valve 21 to shift from going to L20 instead to go to the fourth connection L21.

Accordingly, the only driving air flow to the diaphragm valve 21 comes via conduit L10 and when it is active the air flow is directed through the diaphragm valve either to the third supply conduit L20 or to the fourth supply conduit L21, both of which are in communication with the delay means 22.

The delay means 22 operates to forward the air flow from the third supply conduit L20 to the conduit L3 only after a certain time period has lapsed, i.e. after a certain time delay. One of the inlets S1 to the delay means 22 must accordingly have been affected by an active pressure via conduit L20, in order for air to flow through the delay means 22 to the triggering valve 23. A resetting mechanism 22 is built into the delay means 22, which mechanism is coupled to the second inlet S2. This resetting mechanism, via the inlet S2, is activated when the diaphragm valve directs the air flow from the outlet L10 to go through the fourth supply conduit L21. This redirection takes place in its turn as soon as a pressure change is noted in the diaphragm valve 21. The air flow is accordingly deflected from L10 as soon as an inhalation takes place, which inhalation thus leads to a pressure change in the conduit L1*b* that is connected to the diaphragm valve. As soon as such a pressure change is perceived by the diaphragm valve 21 (i.e. a confirmation of an inhalation), the air flow from L10 will accordingly reset the delay means to its original position, such that once again there is achieved a predetermined time delay before activation of the triggering valve 23 can take place. The triggering valve 23 is a simple logic element always having one of its conduits L1*c* connected to the outlet from the pressure tank 21 and being activated to supply air through the flexible tube 7 as soon as it gets activated via a pressure impulse in the conduit L3 that is coupled to the delay means 22.

Via a first coupling device 26 (only shown schematically in FIG. 2), the actuator 8 can be connected to the pressure tank 1 and the valve device 2. This first coupling device 26 preferably comprises standard valve couplings, which means that the actuator 8 in principle can be fitted to all valve devices 2 on the market, independent of their make, since such devices normally are manufactured with standard couplings to be able to be fitted to different types of equipment. As described above, the valve device 2 normally comprises a reducing valve (not shown) that reduces the air pressure from the pressure tank 1 (normally about 20-30 MPa) such that air of a lower pressure, normally 0.8-1.1 MPa is supplied to the diving jacket 6 and the breathing regulator 4. Also the inflator 3 is provided with air of this lower pressure. It is however realised that in some applications, the reduction can take place in the actuator 8. It is also realised that many advantages can be attained if the actuator 8 is integrated in the valve device 2, such that these form a common unit (not shown).

The figure also shows a flowchart for an adapter 50 that is used in order to connect the actuator 8 to a diving jacket 6 according to the invention, via the diving jacket's coupling device 17. The adapter 50 comprises a coupling device 51, suitably of the above described type, to which the second flexible tube 7 is connected. Two flexible tubes/channels 7', 7" run from the coupling device 51, whereof one flexible tube/channel 7' is arranged to inflate the diving jacket 6 with air, and the second flexible tube/channel 7" is arranged to provide a release mechanism 42 with air in order to initiate automatic dumping of the weights. The flexible tube/channel 7' that is arranged to inflate the diving jacket with air suitably comprises a non return valve 24, such as a ball valve, that prevents air from the diving jacket from flowing backwards to the second flexible tube/channel 7" thereby causing an undesired dumping of the weights. The non return valve 24 is a safety arrangement that in some cases can be dispensed with if the release mechanism 42 is instead adapted to withstand the pressure from the air that otherwise would flow backwards from the diving jacket. Naturally, this presupposes that the air pressure from the diving jacket is lower than the pressure from the actuator for which the release mechanism 42 is adapted. The person skilled in the art will realise that both these pressures will vary, partly depending on the depth at which the diver is and on how much air there is left in the pressure tank. This means that certain restrictions must be introduced in terms of maximal allowed dive depth and smallest allowed pressure in the pressure tank in order for the system to work.

The flexible tube 7 is, in a manner known per se, provided at its end with a spring-loaded ball valve, which means that the flexible tube 7 seals against air flow as soon as it is disconnected from the diving jacket 6 via its coupling point in the form of the coupling device 51 on the adapter 50. This also gives a simple possibility to disconnect the safety arrangement, if desired.

In the shown embodiment, the components of the actuator are in the main mechanical components, such as pneumatic and/or hydraulic controlled valves. This also gives the advantage that the safety device 8 doesn't need electricity to work. Hereby, it can be operated only by air from the pressure tank 1 and be activated by external influence, such as a certain type of moisture and/or a certain water pressure. Hereby, reliability in operation will be extra high. By "a certain type of moisture" should be understood influence that doesn't comprise rain but moisture in a continuous pool of liquid (a lake, a swimming pool, the sea, etc.), whereby the presence of a hydrostatic pressure can be sensed without using a manometer, for example by sensing continuous moisture present on certain areas of the actuator.

Figure 3:
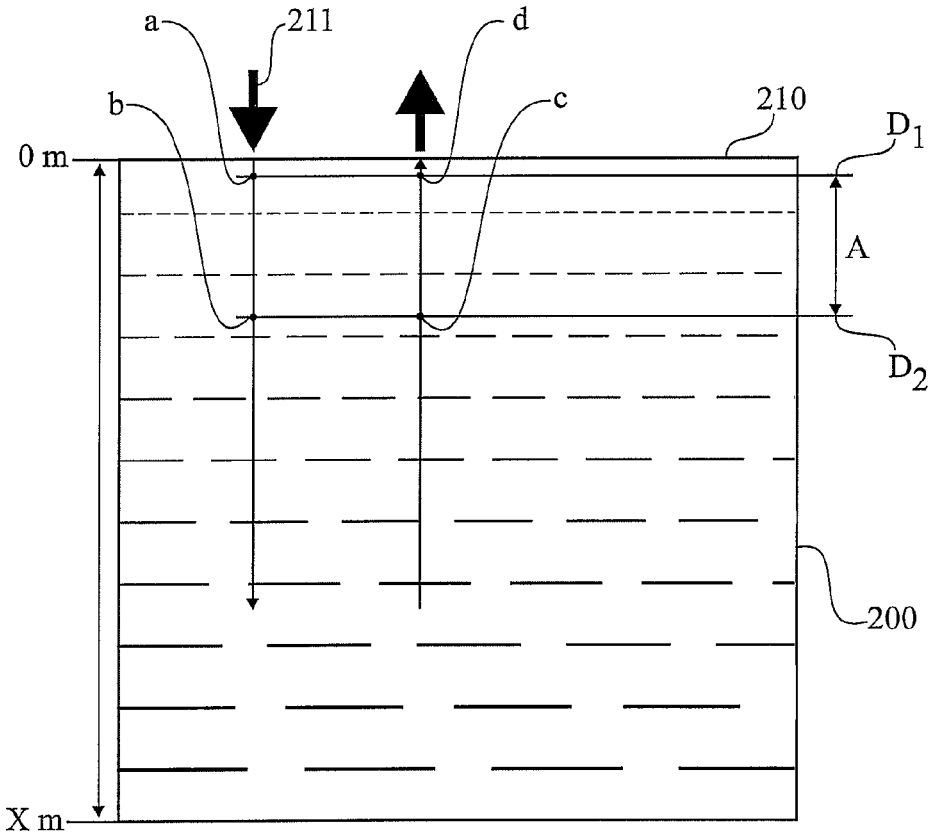
FIG. 3 shows a schematic illustration of a diver using the invention.

FIG. 3 schematically shows the use of a device according to the invention. It schematically shows a vertical section through a water-filled area 200 (such as a part of a lake), with its surface 210 and down to a certain depth corresponding to about 10 metres. With the purpose of illustrating a dive with a device according to the invention, a diver 211 is furthermore symbolised by arrows, the diver 211 performing a dive while passing the points a-d in chronological order. It is also shown that a device according to the invention preferably has an actuation zone A that is defined by an upper depth D1 and a lower depth D2, respectively.

DESCRIPTION OF THE FUNCTION

With reference to FIGS. 2 and 3, the function of the device will now be described. As mentioned above, the method primarily aims to avoid serious accidents in connection with surface related situations. In a preferred embodiment, the actuator 8 is hence arranged to the activated when the diver 211 enters or is in the actuation zone A. Normally, this actuation zone A comprises a zone that extends from a depth D1, of between just below the surface to a depth of about 1 metre, normally 0.1-0.5 m, preferably 0.1-0.3 m and most preferred about 0.2 m below the surface, and down to a desired depth D2, such as 200 m, or if desired to an infinite depth, or to a depth D2 that is normally used for so called safety stops in connection with ascendance to surface, preferably 2-5 m, more preferred 3 m, most preferred about 2.5 m below water surface. If the diver doesn't take a breath in the breathing regulator 4 within a certain predefined time period, the actuator 8 will initiate inflation of the diver's diving jacket 6 and dumping of the weights, whereby the diver 211 will be transported up to the surface 210.

Actuation cannot take place when the diver is outside the actuation zone A, either on shore or not having commenced diving or when diving at a depth that is larger than that defined by the actuation zone A. This function, i.e. the inactive mode, is achieved by the pressure sensing valve 20 being designed to open up an actuation connection L10 under influence of an external water pressure within the range of D1-D2, which comprises the hydrostatic pressure at the upper actuation depth D1 and down to the hydrostatic pressure at the lower actuation depth D2.

At surface position or a position in which the diver 211 is just below surface 210, the valve 20 will be closed such that air cannot be supplied through its outlet conduit L10. In connection with descent the diver 211 will, at a certain point a (see FIG. 3), enter the actuation zone A since then the surrounding water 200 will exert a large enough pressure on the pressure sensing valve 20 to open up the connection via the outlet L10. Hereby, the diaphragm valve 21 will be supplied with air via the conduit L10 and further through the connection conduit L20 that leads to the delay means 22, whereby influence from start mode in a direction towards trigger mode is initiated. This activated mode will not be disconnected until the diaphragm valve 21 is influenced to switch, which takes place as soon as there is breathing in the breathing regulator 4, which will cause a pressure change that via the valve device 2 propagates to connecting conduits, such that the conduit L1*b* connected to the diaphragm valve 21 is influenced to switch the diaphragm valve 21. Hereby, switching of the diaphragm valve 21 is effected such that the air supplied to the outlet L10 from the pressure valve 20 is redirected inside the diaphragm valve 21 in order to discharge in the fourth connection L21, which affects a resetting of the delay means 22. This procedure will be repeated as long as the diver is within the actuation zone A. Under the condition that breathing takes place within a predefined time of delay T (which is predefined in the delay means 22), the triggering valve 23 will accordingly not be influenced via L3, which in turn means that the jacket 6 will not be inflated and that the weights will not be dumped.

The actuation time T1 for the pressurized air to affect the delay means from start mode to trigger mode is considerably much longer, a magnitude of 10-100 times, preferably 10-20 times as long as the resetting time T2 for the pressurized air to affect the delay chamber in the opposite direction i.e. to the start mode, which resetting time T2 is not more than 2 seconds, preferably not more than 1.5 seconds and most preferred not more than 1 second.

As soon as the descending diver has passed the lower actuation depth D2, i.e. has passed point b in FIG. 3, the pressure of the surrounding water 200 will influence the pressure sensing valve 20 to take a second end position in which it once again closes such that air cannot discharge through its outlet L10. The pressure sensing valve 20 will however maintain a connection through the outlet L10 if initiation already has been commenced when the diver passes the lower actuation depth D2. Accordingly, the mechanism is not automatically deactivated by the diver entering a zone below the lower actuation depth D2, but also in this case the triggering mechanism is deactivated only in connection with the diaphragm valve 21 sensing breathing, whereby the delay means is reset. If the diver 211 has been in the actuation zone A, e.g. having passed through the actuation zone as he sinks due to not having been able to secure surface buoyancy, the actuator 8 continues to be active even after the diver 211 has passed the lower predefined actuation depth D2. Hence, the device is deactivated only when the diver 211 once again breathes in his breathing regulator 4. In other cases, the weights are dumped and the diving jacket 6 is inflated and lifts the diver 211 to the surface 210.

When the diver is then below the lower actuation depth D2, the actuation mechanism 8 cannot be initiated since the pressure regulating valve 20 is in one of its closed positions.

When the diver then starts ascent and reaches an ascent point c at which the water 200 exerts a pressure on the pressure sensing valve 20 that once again has opened the connection to the outlet L10, driving air will once again be supplied to the diaphragm valve 21. Thereby, the functionality of the actuator 8 is the same as has been described above, as long as the diver is within the actuation zone A. The actuator will not be deactivated again until the diver has ascended to a point d at which the pressure of the surrounding water 200 falls below the predefined upper actuation depth D1. When the diver is at the surface he can accordingly throw out his breathing regulator 4 without risking that the diving jacket 6 inflates without due cause. If the diver on the other hand starts to sink, he would re-enter into the actuation zone A and in that case a deactivation of the actuator 8 can only take place by once again breathing in the breathing regulator 4. According to an alternative embodiment, the pressure sensing valve 20 is arranged such that it only arrests supply through the outlet L10 in connection with the diver leaving the actuation zone A via the lower depth limit D2, while it accordingly disconnects from actuation when the diver leaves the actuation zone A via the upper actuation depth D1. Hereby, the risk of the diving jacket 6 being inflated by error if the diver 211 after a successful ascent and before final ascent makes a brief descent, i.e. by mistake ends up in the actuation zone A just before ascent, is eliminated.

According to one embodiment according to the invention, the delay means 22 is constituted by a mechanical device comprising a hydraulic delay chamber (not shown). The hydraulic delay chamber allows an adjusting means of the delay means to move at different speeds in the two directions, by allowing a larger liquid flow through in one direction and a smaller liquid flow through in the other direction. Depending on from which conduit L20, L21 that the pressurized air acts on the hydraulic delay chamber, the adjusting means will accordingly move at different speed. When the pressurized air affects from the third conduit L20, the adjusting means will move from start mode in a direction towards trigger mode, whereby a considerably much smaller flow is allowed than if the pressurized air affects via the second conduit L21. This means that the hydraulic delay chamber will operate as a timer, for which the time for the delay means to move from start mode to trigger mode can be chosen by controlling the flow resistance in the respective direction.

Suitably, the time is chosen such that in case the diver does not breathe in the breathing regulator, the delay chamber should shift from start mode to trigger mode within 30 seconds, preferably within 20 seconds. If the diver during that time finds his breathing regulator 4 or alternatively breathes as usual in the breathing regulator when he is in the actuation zone A, the breathing will cause a pressure drop in the second connection L1*b*, which affects the diaphragm controlled valve 21 to redirect the air to the fourth connection L21. When the pressurized air affects this side S2 of the liquid filled delay chamber, a considerably much larger flow opens up through the delay chamber and this means that in the short time period that is required for the diver to inhale air, the liquid controlled delay chamber will be shifted to start mode and the safety function will be reset to start mode. This procedure is repeated as long as the diver is in the actuation zone A, since then the pressure valve 20 will supply driving air to the diaphragm controlled valve 21, which means that the delay chamber repeatedly starts to move in a direction from start mode to trigger mode as soon as a static pressure is reinstated in L1*b*, affecting the diaphragm valve 21 to guide the air towards the first side S1. The diver's breathing in the breathing regulator 4 will accordingly cause the pressure drop in the second connection L1*b*, which resets the delay chamber.

If on the other hand an emergency situation arises in which the diver does not find his breathing regulator within the predetermined time period, the liquid controlled delay chamber will by influence of the pressurized air be moved from start mode to trigger mode. Upon entry into the trigger position, a sixth connection L3 for pressurized air opens up via the delay chamber and to the trigger valve 23. By influence of the pressurized air via L3, the trigger valve 23 opens and thereby a direct connection L1*c* opens from the valve device 2 to the diver's diving jacket 6, which momentarily starts to inflate. The air will also affect the release mechanism 42 to trigger off, whereby the weights are dumped. The diver will automatically get the buoyancy needed to float up to surface.

Figure 4:
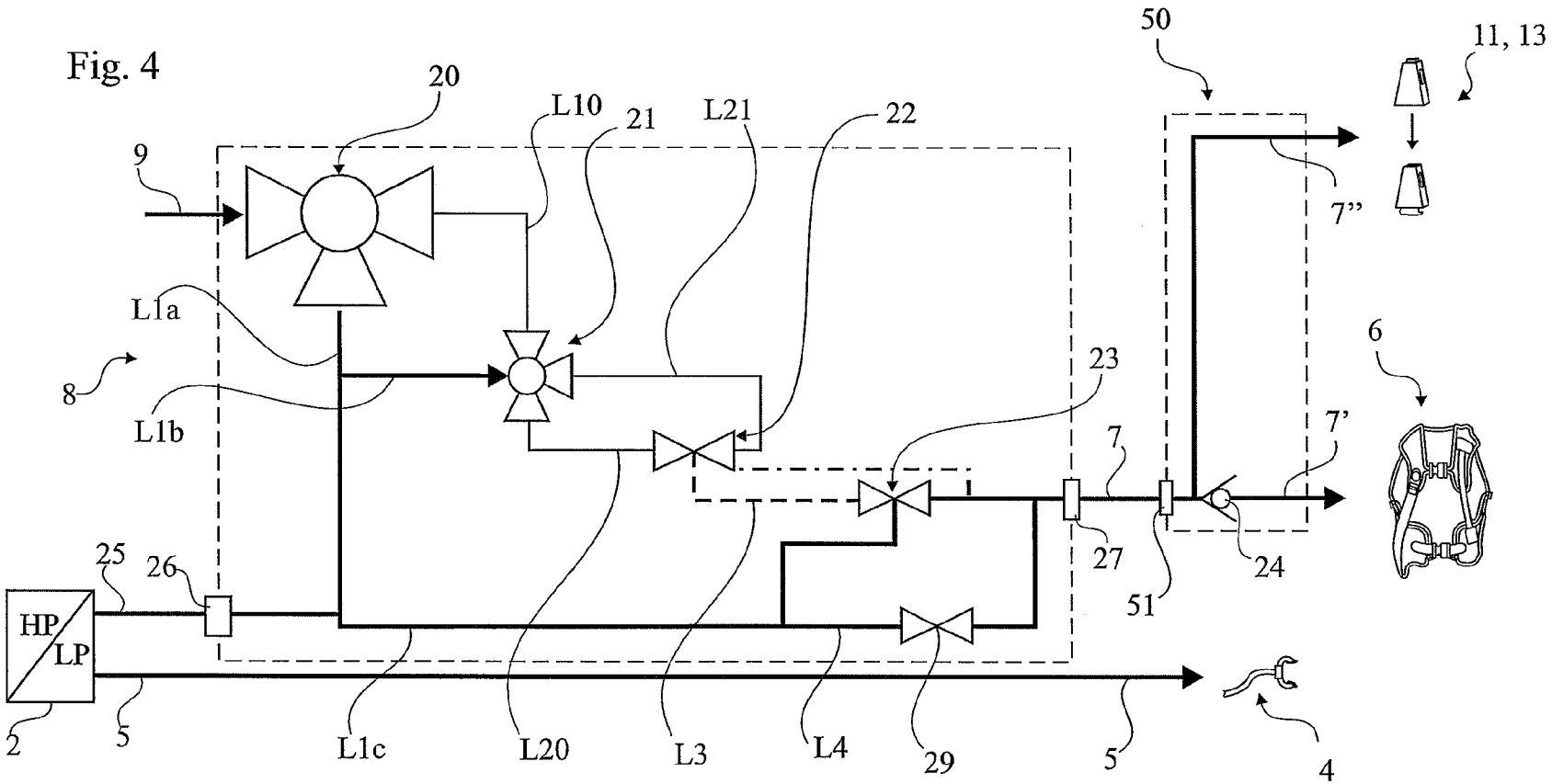
FIG. 4 shows a somewhat modified flowchart over an actuator according to the invention.

FIG. 4 shows an alternative embodiment of an actuator 8 according to the invention. In this embodiment, the actuator 8 consists of a separate unit connected to the diving equipment in the manner shown in FIG. 1*a*. In principle, it has the same built-in functionality as is shown in FIG. 2, which is shown by the same type of components having been given the same reference numbers. The modification according to FIG. 4 consists in that an additional valve 29 has been provided in a conduit L4 of its own, which conduit L4 connects the conduit L1*c* with the outlet 7 to the jacket 6, such that it forms a "by-pass" past the trigger valve 23. This additional valve 29 has the functionality that it opens up for automatic inflation of the jacket 6 and dumping of the weights when the air in the bottle 1 is about to run out. Accordingly, the purpose of the valve 29 is to eliminate the risk that the diver runs out of air during a dive, and instead he will be automatically brought up to the surface when the air is about to run out. Hence, the additional valve 29 will control the opening and forming of a connection with any type of sensing able to detect that air is about to run out, e.g. by using a manometer (not shown) to control the additional valve 29 when the operating pressure supplied via the coupling 25 has decreased to a certain level below "normal operating pressure", e.g. to open up at a pressure of 0.5 MPa when the operating pressure, i.e. after the reducing of the reducing valve, is set to be about 0.7-0.8 MPa. It is realised that naturally the reducing valve can be arranged inside a house 100 belonging to the actuator 8.

Figure 5:
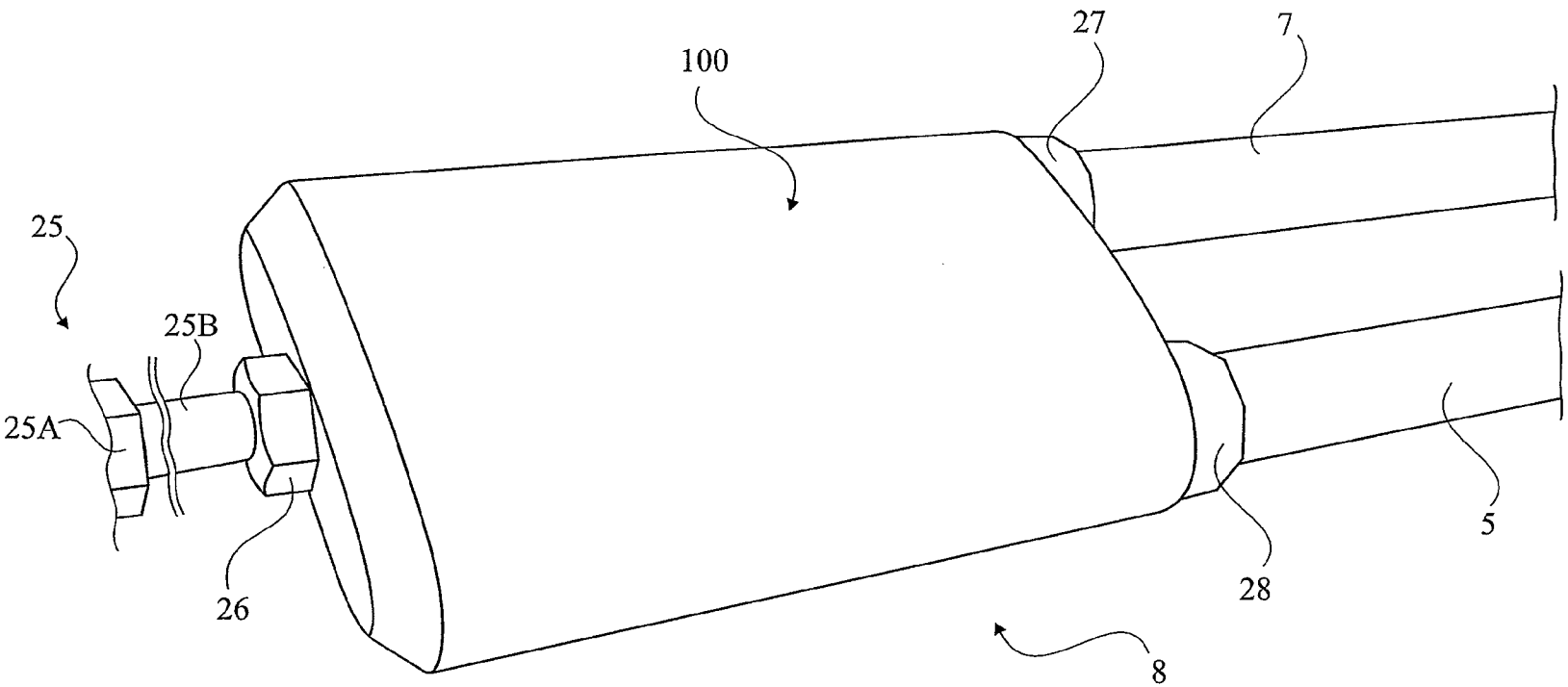
FIG. 5 shows a conceived embodiment of an actuator according to the invention.

FIG. 5 shows an embodiment of an actuator 8 according to the invention. It is clear that the device 8 is a house 100 of relatively small dimensions, which means that the device is easy to bring along thanks to being relatively small and non bulky. The approximate dimensions of the shown embodiment are 100×50×20 mm. The house 100 accommodates the conduits and valves required according to the description above (see FIGS. 3 and 4.) Moreover, there are couplings 26, 27 that are necessary to connect the device 8 between the valve device 2 on the pressure tank 1 and the jacket 6. As is known to the person skilled in the art, these couplings can be made in many ways known per se, to provide sealing couplings. Suitably, the coupling 25 between the actuator 8 and the valve device 2 on the pressure tank 1 is however provided in the form of a flexible connector 25B (such as a reinforced rubber hose) that by a coupling device 26B (here indicated by a nut coupling but naturally many types of couplings can be used, such as quick couplings), such that any forces that arises and that act on the actuator 8 (e.g. in the form of blows or bending stresses) will not result in high stress on any of the coupling devices 26, 25A, but instead will be absorbed/dampened by the flexible connector 25B. Moreover, the coupling 27 to the jacket may advantageously be a quick coupling known per se, which comprises a closing mechanism that closes as soon as the coupling is taken apart (normally a spring loaded ball that seals against a seat, which ball opens up/is pushed away when coupling takes place). Thanks to this built-in functionality, the flexible tube 7 to the jacket can if desired always be disconnected, even below surface, without affecting the rest of the equipment or the functionality.

Figure 6B:
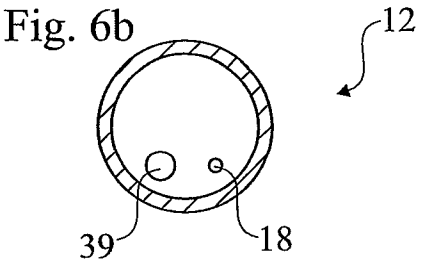
FIG. 6*b* shows a cross-section of the flexible tube 12 with the cord 18 and the fourth connection 39 that runs inside it.
Figure 6A:
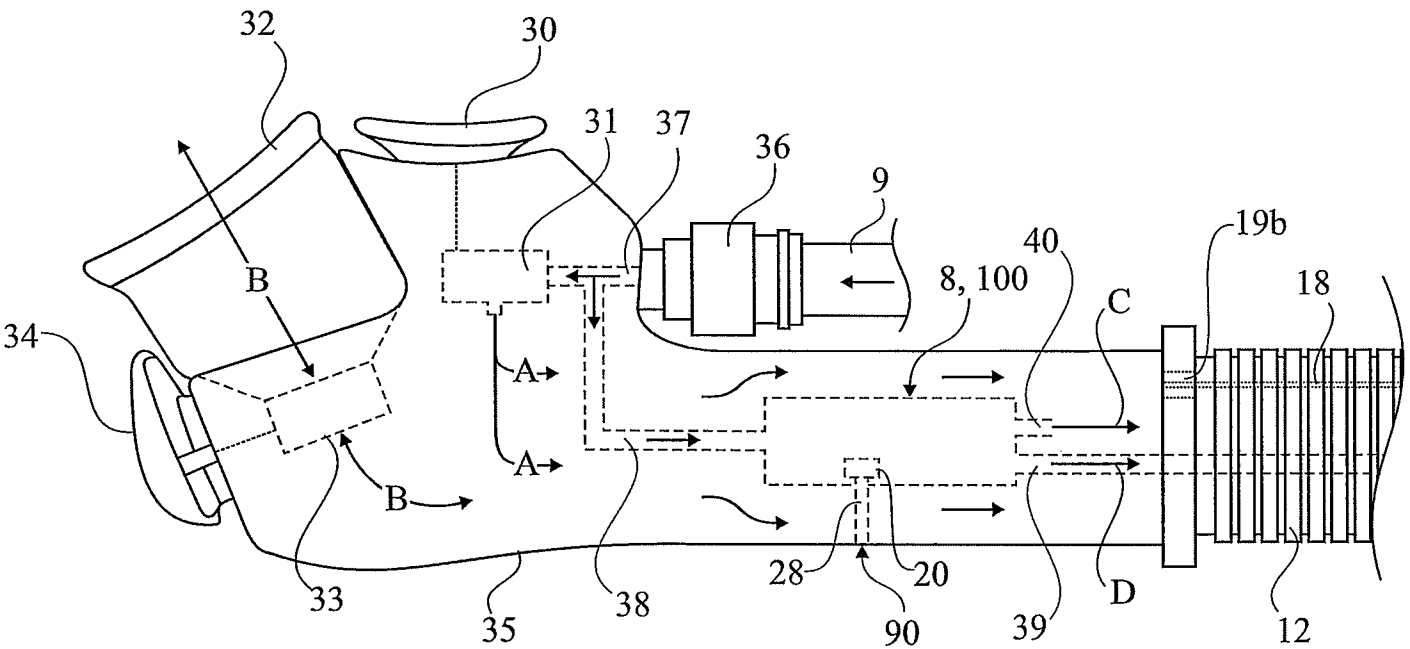
FIG. 6*a* shows a side view of an inflator according to the invention.

FIG. 6*a* shows a side view (and schematically also the interior) of an inflator 3 that is known per se, which has been provided with an actuator 8 according to the invention, such that an inflator 3 of considerably much better function is thereby achieved. The inflator consists of a hollow and water tight casing, here in the form of a grip friendly handle that is connected via the third flexible tube 9 to the pressure tank 1, and via the third flexible tube 12 to the diving jacket 6. A cavity is formed inside the water tight casing 35, which cavity is in open communication with the diving jacket 6, via the flexible tube 12 and the coupling device 17. These components, i.e. the cavity in the casing 35, the flexible tube, the coupling device 17 and the diving jacket 6 will accordingly form a continuous room inside which the air can flow freely in both directions. A coupling 36 for the flexible tube 9 from the valve device 2 is advantageous a quick coupling of the same type as described above, whereby the same advantages will be achieved in respect of the possibility to disconnect the flexible tube 9. The flexible tube 12 is connected to the casing 35 in a shaft-like part that has been given a somewhat longer extension than normal in order to make room for the actuator 8. Preferably, the actuator 8 also here comprises a house 100 that advantageously can form an integral part of the casing 35 of the inflator. The house 100 accommodates the conduits and valves required according to the description above (see FIGS. 3 and 4.) Between the actuator 8 and the casing 35 there is a first connection 28 that is open to the surroundings. The connection 28 connects to the pressure sensing valve 20 inside the actuator (schematically shown), such that the pressure from the surrounding water 200 can propagate to the valve.

Inside the casing there are a couple of valves 31, 33 that can be affected by buttons 30, 34. A second connection 37 in the form of a conduit/flexible tube for filling runs from the coupling 36 to a filling valve 31 that, when it is opened, allows air from the pressure tank to flow into the cavity in the interior of the inflator (indicated by arrows at the letter A) and further via the flexible tube 12 to the diving jacket in order to inflate the diving jacket with air. The inflator also comprises a mouthpiece 32 that is in communication with the cavity inside the inflator via a combined emptying and filling valve 33 that can be opened by the button 34.

From a branching in the second connection 37, there is a third connection 38 for pressurised air from the pressure tank 1 via the valve device 2, to the actuator 8. It should be noted that this third connection 38 is always in open communication with the valve device 2. The actuator 8 further comprises an outlet 40 for pressurised air (indicated by the arrow at the letter C) from the trigger valve 23 and the additional valve 29 (if such exists) to the hollow interior of the inflator, from which the pressurised air can flow to the diving jacket via the flexible tube 12 in order automatically to inflate the same.

From the actuator 8 there is a fourth connection 39 intended for pressurised air (indicated by the arrow at the letter D) that is to be used to initiate automatic dumping of the weights from the diving jacket. This fourth connection 39 preferably consists of a flexible tube that via the coupling device 17 and the connection 41 leads the pressurised air to a release mechanism that when affected will initiate dumping of the weights. Finally the figure shows a cord 18 that runs inside the flexible tube 12 and an attachment 19*b* for the cord, arranged in the casing 35. The cord 18 is connected to a spring-loaded emptying valve 79 in an inflator coupling 80 that is modified for this purpose, by aid of which the inflator 3 according to the invention can be connected to the diving jacket 6 (shown in FIG. 8). By tensioning the cord 18, the diving jacket can be emptied of air via the valve 79. This functionality will facilitate for the diver since he otherwise must raise the inflator 3 in direction towards the surface, to a level above the diving jacket where the surrounding water pressure is somewhat lower in relation to the diving jacket, in order to be able to empty it of air.

An inflator 3 according to the invention, which has been provided with an actuator 8 according to the invention, will accordingly enable manual as well as automatic filling of the diving jacket. Manual filling of the diving jacket takes place by depression of a first button 30 on the inflator 3, which opens the filling valve 31 that, when opened, allows air from the pressure tank to flow into the cavity in the interior of the inflator and via the flexible tube 12 to the diving jacket. The inflator furthermore comprises the mouth piece 32 through which air also can be blown into the cavity, whereby the diver himself can inflate the diving jacket. In order to be able to inflate the diving jacket via the mouth piece, the diver must open the combined emptying and filling valve 33, which is done by keeping a second button 34 depressed. Hereby a passage is opened (in the figure indicated by the arrows at the letter B) between the cavity and the mouth piece 32. This passage will also allow for emptying of air from the diving jacket, which takes place momentarily unless the diver has shut the opening of the mouth piece 32 and blows air into it. As realised, the mouth piece will also allow the diver to use the air in the diving jacket for breathing, only for a limited time however. As is also realised, a situation may arise in which the diver for some reason may have lost his breathing regulator 4, e.g. due to failure, whereby he nevertheless will be able to breathe through the mouth piece 32 by keeping both buttons 30 and 34 depressed. Thanks to an actuator according to the invention now having been integrated in the inflator, yet another important safety function can now be offered. If the diver does not have enough presence of mind to remember to open the valve 31, the actuator 8 will be activated when the predetermined time period T for delay has run out, whereby air from the pressure tank will flow into the cavity of the inflator. This air will inflate the jacket and dump the weights and at the same time the diver will receive more air for breathing. It is realised that it is an advantage if the actuator, when once having been activated, continues to be in the open position such that the connection L1*c* is constantly kept open for supply of breathing air from the pressure tank 1.

This part of the invention is applicable without connection with the other parts of the inventive concept. In other words, an inflator according to the invention, in which the actuator is connected as described above, can have the advantage that no additional tube is required between the actuator and the diving jacket. Nor is an additional adapter required in order to connect the tube/tubes from the actuator to the coupling device 17 on the diving jacket 6, which is the case when a separate actuator is to be connected to the diving jacket. Yet another advantage is that an outlet on the valve device 2 is liberated, which thereby can be used for other purposes. Yet another advantage is that no extra measures have to be undertaken, in the form of flexible couplings, etc., in order to make sure that the actuator 8 will withstand external loads, such as described in connection with FIG. 5. Naturally, production economical advantages are achieved by integrating the actuator in the inflator, such as in the form of a decreased material consumption.

FIG. 6*b* shows another cross-section of the flexible tube 12 with the cord 18 and the fourth connection 39 that runs inside it.

Figure 7:
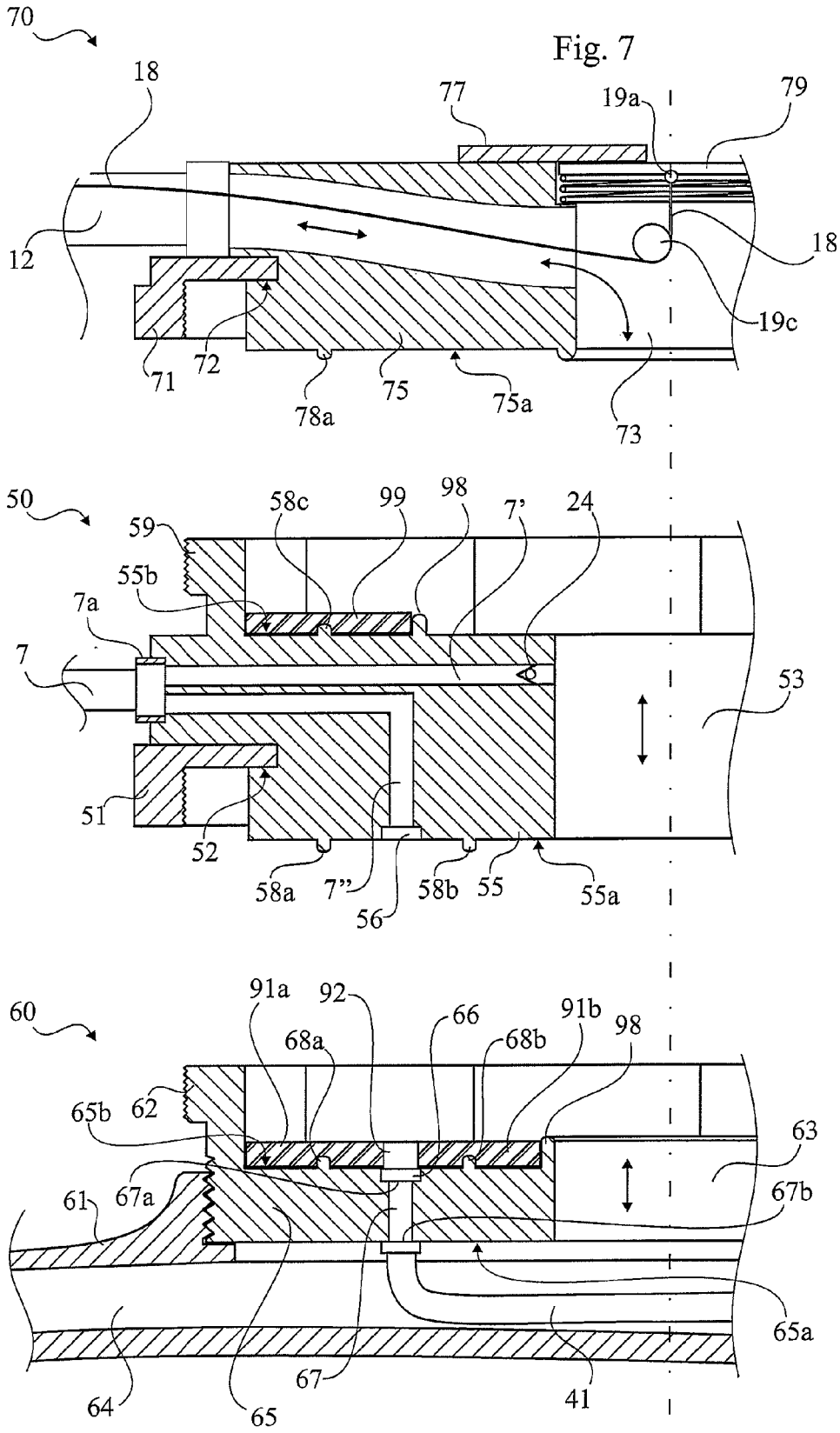
FIG. 7 shows an exploded view of the comprised parts in a cross-section of a first embodiment of a coupling unit intended to connect a separate actuator according to the invention and a conventional inflator with a diving jacket according to the invention.

FIG. 7 shows an exploded view over the comprised parts in a cross-section of a first embodiment of a coupling device 17 intended to connect a separate actuator 8 according to the invention and a conventional inflator 3 with a diving jacket 6 according to the invention. The coupling device comprises a jacket coupling 60 according to the invention, an adapter 50 according to the invention and a conventional inflator coupling 70, which are easily coupled together by a thread coupling.

The jacket coupling 60 according to the invention, which is joined with the diving jacket 6, comprises a threaded coupling device 62 in the form of a sleeve that is provided with a bottom 65, which is suitably arranged in air tight connection with the outer shell 61 of the diving jacket. The tube coupling 62 comprises a passage 63 for pressurised air to and from an inflatable room 64 in the interior of the diving jacket. The passage 63 consists of a through hole in the centre of a bottom piece 65 of the tube coupling. The bottom piece 65 comprises a groove 66 that extends in circumferential direction along the upper side 65*b* of the bottom piece. In this connection, the upper side of the bottom piece is the side that forms opposing side to the underside 65*a* of the bottom piece that faces the interior of the diving jacket. In the bottom of the groove 66, there is an inlet 67*a* to a channel 67 with an outlet 67*b* on the underside 65*a* of the bottom piece, to which the conduit 41 that forms the connection with the release mechanism 42 is connected. A sealing 90, 91*a*, 91*b* rests on the upper side 65*b* of the bottom piece, which sealing is at least partly held in place by a rim 98 at the edge of the opening 63. The sealing 90, 91*a*, 91*b* comprises at least one hole 92 that connects the groove 55 with a corresponding groove 66 in the overlying adapter 50. Two circular ridges 68*a*, 68*b* that surround the groove 66 are arranged on the upper side 65*b* of the bottom piece. These ridges cooperate with corresponding ridges 58*a*, 58*b* on the overlying adapter 50 and the sealing 90, 91*a*, 91*b*, such that two sealing contact surfaces are formed between the opposing pairs of ridges 58*a*, 68*a*, 58*b*, 68*b* and the sealing 90, 91*a*, 91*b*. The inner sealing surface 58*b*, 68*b*, 91*b* is primarily intended to prevent the air, that is supplied to the diving jacket via the passage 63, from flowing into the groove 66 and further through the channel 67 and the flexible tube 41, to the release mechanism 42. The outer contact surface 58*a*, 68*a*, 91*a* will, together with the inner contact surface 58*b*, 68*b*, 91*b*, make sure that the air supplied to the diving jacket via the channel 7" is further conveyed to the channel 67. Naturally, the outer contact surface 58*a*, 68*a*, 91*a* will also make sure that pressurised air cannot pass through the joint between the adapter 50 and the jacket coupling 60.

The adapter 50 according to the invention, which is positioned as a joining piece between the jacket coupling 60 and a conventional inflator coupling 70, is provided with a threaded connection ring 51 that runs freely in a groove 52 in the outer edge of the adapter. The adapter and the jacket coupling 60 are connected by screwing the connection ring 51 onto the threaded tube coupling 62. The adapter can be seen simply as a sleeve with a comparatively thick wall 55, and the through hole in the centre of the sleeve consists of a passage 53 for pressurised air. At least at its lower part, the hole preferably has the same diameter as the hole that forms the passage 63 in the jacket coupling. In the wall 55, there are two channels 7', 7", the inlets of which coinciding in a recess in the outside of the wall to which the flexible tube 7 is connected by some type of suitable coupling 7*a*. Pressurised air from the actuator 8 is led via the flexible tube 7 and the two channels 7', 7", to the diving jacket 6

One channel 7' is arranged to lead the pressurised air to the diving jacket 6 and mouths in the passage 53. The other channel 7" mouths in a groove 56 in the underside 55*a* of the wall 55. The groove coincides in the circumferential direction with a corresponding groove 66 on the upper side 65*b* of the wall 65 of the jacket coupling and is surrounded by two circular ridges 58*a*, 58*b* that cooperate with corresponding ridges 68*a*, 68*b* of the underlying jacket coupling 60 and the seal 90, 91*a*, 91*b*, as is described above. The other channel 7" is arranged, via the channel 67 of the jacket coupling 60 and the connection 41, to lead the pressurised air to the release mechanism in order to initiate automatic dumping of the weights. The channel 7' comprises a non return valve 24, such as a ball valve, that prevents air from the diving jacket from flowing backwards to the other channel 7", because if that happened it could cause an undesired dumping of the weights.

A threaded coupling device 59 is arranged along the outer edge of the upper side, which coupling device extends axially as a thinner wall, the dimensions of which matching a corresponding coupling device 62 of the jacket coupling 60. This is beneficial since it makes it easy to connect the adapter to an existing inflator coupling 70 without requiring other measures in the form of transitions, etc. A sealing 99 rests on the upper side 55*b* of the relatively thick wall, which sealing is at least partly held in place by a rim 98. On the upper side 55 of the wall there is furthermore a circular ridge 58*a* that cooperates with a corresponding ridge 78*a* of the overlying inflator coupling 70 and the sealing 99, preventing pressurised air from passing in the joint between the adapter 50 and the inflator coupling 70.

The inflator coupling 70, which is known per se, also acts as a sealing cap on the coupling device 17 and its design reminds of the adapter 50 in several aspects. The inflator coupling 70 has the shape of a round disc with a relatively thick wall 75, where the through hole in the centre of the disc forms a passage 73 for pressurised air. In the wall 75, there is a through channel 74 from the outside of the wall and in to the passage 73, to which the flexible tube 12 from the inflator 3 is connected. Via the flexible tube 12, the diving jacket can be manually filled and emptied of air, which has been described in connection with FIG. 6*a*.

The upper opening of the passage 73 is covered by a perforated cap 77. Inside the passage 73, there is a spring-loaded valve 70 that seals against the cap 77. The valve comprises an attachment 19*a* for a cord 18 that runs about a deflection means 19*c* and further through the channel 74 and the flexible tube 12, to the inflator 3. The valve 79 can be opened in order to release air from the diving jacket by tensioning the cord 18, which is described in connection with FIG. 6*a*.

The inflator coupling comprises a threaded connection ring 71 that runs freely in a groove 72 in its outer edge, by aid of which the inflator coupling can be screwed together with the adapter 50. According to the same principle as has been described above, a sealing contact surface is formed between a circular ridge 78*a* on the underside 75 of the wall, corresponding to the circular ridge 58*c* of the adapter 50 and the sealing 99.

Figure 8:
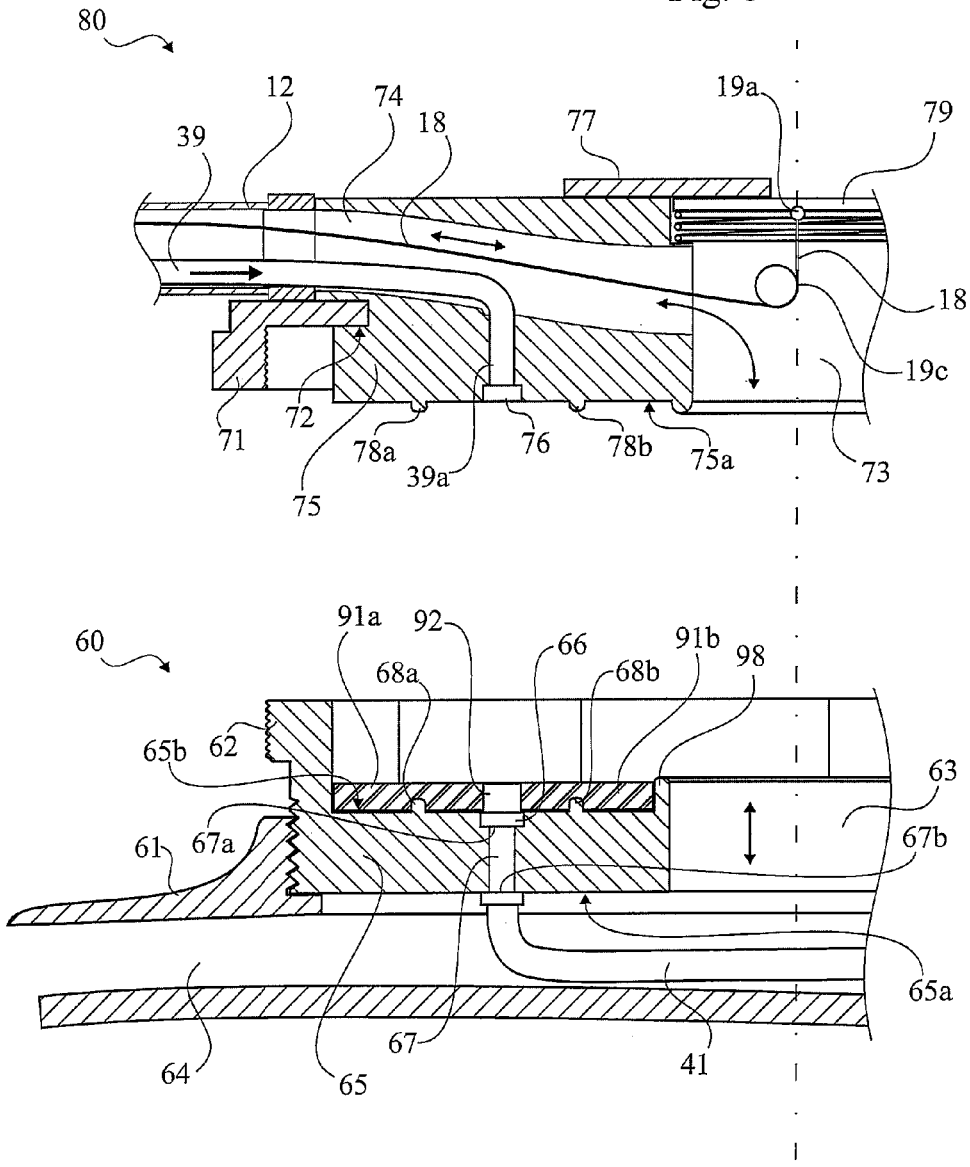
FIG. 8 shows an exploded view of the comprised parts in a cross-section of a second embodiment of a coupling unit intended to connect an inflator according to the invention with a diving jacket according to the invention.

FIG. 8 shows an exploded view over the comprised parts in a cross-section of a second embodiment of a coupling device 17 intended to connect an inflator 3 according to the invention, in which the actuator 8 has been integrated, with a diving jacket 6 according to the invention. The coupling device comprises a jacket coupling 60 according to the invention, which fully corresponds to the jacket coupling described in connection with FIG. 7, and reference is hence made to that description.

The inflator coupling 80 according to the invention reminds largely of the known inflator coupling 70 that is also described in connection with FIG. 7. In principle, it has the same built-in functionality as is shown in FIG. 2, which is shown by the same type of components having been given the same reference numbers. The modification of FIG. 8 consists in that the channel 74 in the wall 75 has been provided with a bifurcation 39*a* in the form of a hole that mouths in a groove 76 in the underside 75*a* of the wall 75. The groove coincides in the radial direction with the corresponding groove 66 on the upper side 65*b* of the wall 65 of the jacket coupling. In the bifurcation 39*a*, the flexible tube 39 from the inflator 3 according to the invention, which runs inside the flexible tube 12, can be led to the groove 76 and be attached. Suitably, the flexible tube 12 is attached to the channel 74 via some type of coupling (schematically shown). Alternatively, the flexible tube 39 is connected at the inlet of the bifurcation 39.

The flexible tube 39 is arranged, via the channel 67 of the jacket coupling 60 and the connection 41, to lead the pressurised air from the actuator 8 to the release mechanism 42 in order to initiate automatic dumping of the weights. One essential aspect in this connection is that the flexible tube 39 and the bifurcation 39*a* form a closed connection between the actuator 8 and the groove 76.

The groove 76 is surrounded by two circular ridges 78*a*, 78*b*, that cooperate with corresponding ridges 68*a*, 68*b* of the underlying jacket connection 60 and the sealing 90, 91*a*, 91*b*. The inner sealing surface 78*b*, 68*b*, 91*b* is primarily intended to prevent the air, that is supplied to the diving jacket via the passage 73, 63, from flowing into the groove 66 and further through the channel 67 and the flexible tube 41, to the release mechanism 42. The outer contact surface 78*a*, 68*a*, 91*a* will, together with the inner contact surface 78*b*, 68*b*, 91*b*, make sure that the air supplied to the diving jacket via the flexible tube 39 is further conveyed to the channel 67. Naturally, the outer contact surface 78*a*, 68*a*, 91*a* will also make sure that pressurised air cannot pass through the joint between the inflator coupling 80 and the jacket coupling 60.

Figure 9:
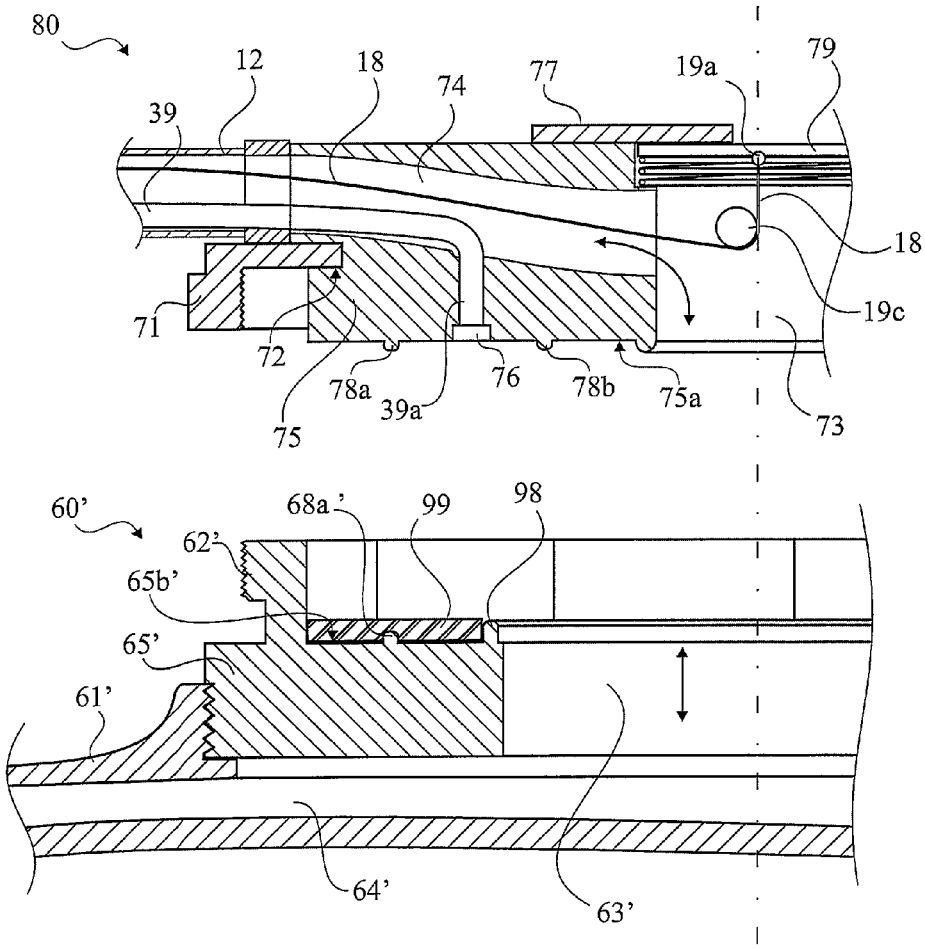
FIG. 9 shows an exploded view of the comprised parts in a cross-section of a third embodiment of a coupling unit intended to connect an inflator according to the invention with a diving jacket according to prior art.

FIG. 9 shows, in an exploded view, how an inflator according to the invention (with an integral actuator) can be connected with a diving jacket according to prior art. The coupling device comprises an inflator coupling 80 according to the invention, which fully corresponds to the inflator coupling described in connection with FIG. 8, and reference is hence made to that description.

The jacket coupling 60' according to prior art, which is joined with the diving jacket 6 according to prior art, comprises a threaded coupling device 62' in the form of a sleeve that is provided with a bottom 65', which is suitably arranged in air tight connection with the outer shell 61' of the diving jacket. The tube coupling 62' comprises a passage 63' for pressurised air to and from an inflatable room 64' in the interior of the diving jacket. The passage 63' consists of a through hole in the centre of a bottom piece 65' of the tube coupling. A sealing 99' rests on the upper side 65*b*' of the bottom piece, which sealing is at least partly held in place by a rim 98 at the edge of the opening 63'. A circular ridge 68*a*' is arranged on the upper side 65*b*' of the bottom piece, which ridge cooperates with a corresponding ridge 78*a* of the overlying inflator device 80 and sealing 99 according to the invention, such that a sealing contact surface is formed which prevents the pressurised air that is led into the jacket via the passage 63' from passing the joint between the two couplings 60', 80.

It is realised that connection of a conventional diving jacket and an inflator according to the invention in which the actuator 8 is integrated, can be done without any need of extra measures, which is advantageous. By using an inflator according to the invention, all the advantages thereof are achieved except the function of automatic dumping of the weights, since a conventional diving jacket lacks this function.

Figure 10:
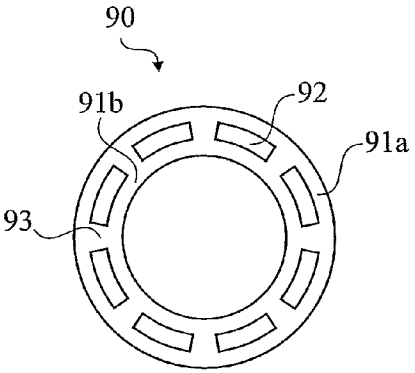
FIG. 10 shows a top view of a sealing according to the invention.

FIG. 10 shows a sealing according to the invention in a preferred embodiment in a view from above. The sealing 90 suitably consists of a ring of a suitable material, such as rubber, of suitable thickness. The ring comprises at least one through hole, or even more preferred a number of grooves 92 that extend in the circumferential direction. The grooves 92 are separated by spacing members 93. The spacing members 93 preferably form integral part of the sealing.

Figure 11B:
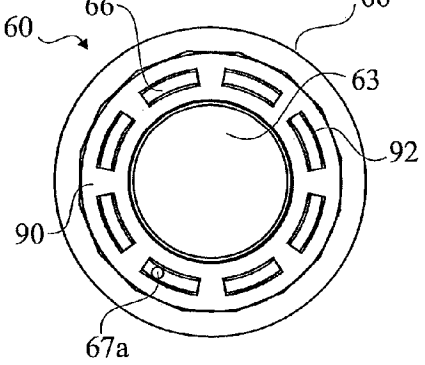
FIGS. 11*a-b* show top view of a jacket coupling according to the invention.
Figure 11A:
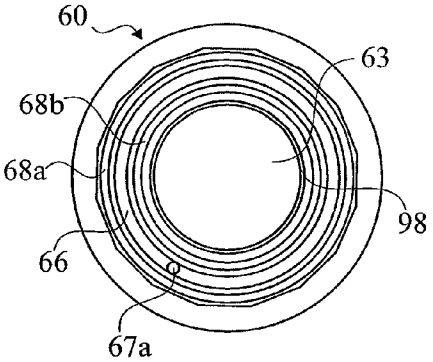

FIG. 11*a* shows the upper side of a jacket coupling 60 according to the invention, in a planar view, i.e. the figure shows the side that forms opposing and cooperating side to/with the inflator coupling as these are connected to each other. The figure shows the air passage 63 to the diving jacket, the two ridges 68*a*, 68*b* that surrounds the groove 66 and in the bottom thereof the inlet 67*a* to the connection 41 is seen.

FIG. 11*b* shows a planar view of the jacket coupling 60 with the sealing 90 positioned therein. It is clear from the figure that the grooves of the sealing axially coincide with the groove 66 of the jacket coupling, such that air intended for initiating dumping of the weights is given free passage down into the groove.

Figure 12B:
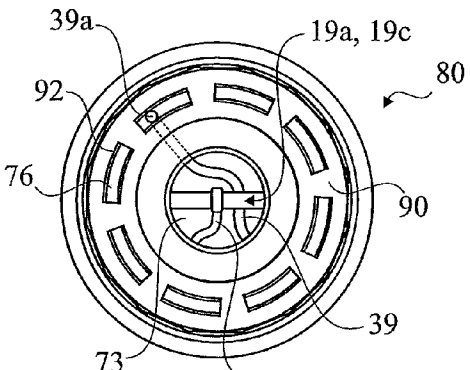
FIGS. 12*a-b* show a bottom view of an inflator coupling according to the invention.
Figure 12A:
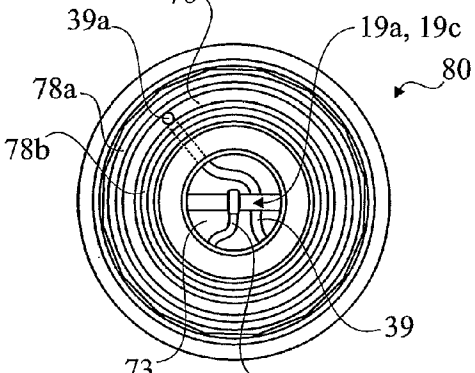

FIG. 12*a* shows the underside of an inflator coupling according to the invention, in a planar view. The figure shows the air passage 73 to the diving jacket, the two ridges 78*a*, 78*b* that surround the groove 76 and in the bottom of the groove 76 the outlet 39*a* from the bifurcation 39*a* is seen, which supplies the pressurised air that is used to initiate dumping of the weights.

FIG. 12*b* shows the inflator coupling in a view from below. The sealing 90 has been positioned on top of the ridges 78*a*, 78*b* only to show how the sealing function is achieved on both sides of the groove 76.

From the above description of the jacket coupling 60, the sealing 90 and the inflator coupling 80, it is realised that it is advantageous, from a functional point of view among other things, to design the sealing such that the two sealing surfaces 91*a*, 91*b* that cooperate with the ridges 68*a*, 68*b*, 78*a*, 78*b*, are fixed in relation to each other by the spacing members 93 that are formed between the holes 92 of the sealing. It is also realised that it is advantageous for the inlet 67*a* and the outlet 39*a* for the air that is to initiate the dumping of the weights to be positioned in the grooves 66, 76, as this means that the connection of the couplings 60, 80 to each other can be made without having to concern about any particular way of fitting the couplings in the rotational direction. Naturally, this is also true for the above described embodiments of the coupling device 17.

Figure 13B:
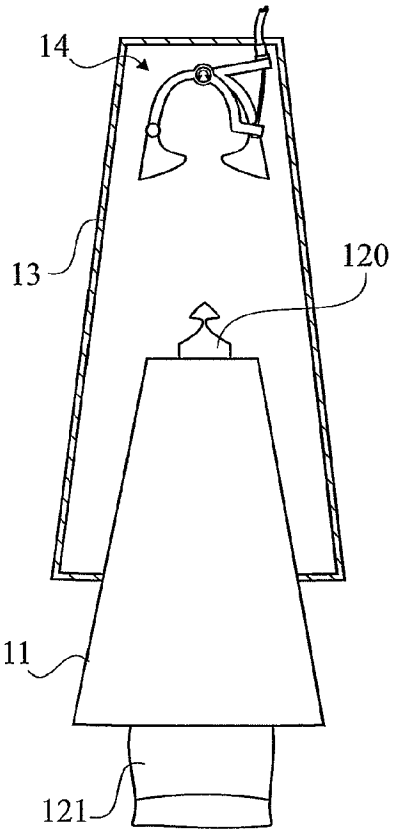
FIGS. 13*a-b* show an alternative embodiment of a pocket and a weight.
Figure 13A:
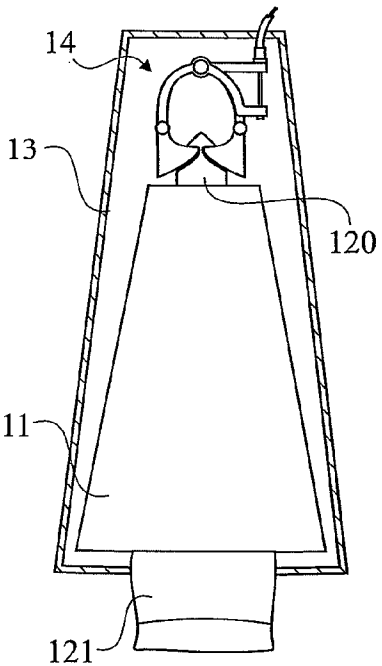

FIGS. 13*a* and 13*b* shows an alternative embodiment of the pockets 13 with the weights 11, in which the holder 14 is designed by aid of spring-loaded gripping means to grip and hold fast the attachment 120 on the upper side of the weight 13. FIG. 13*a* shows the holder 14 in a position in which the weight 11 has been locked in place. FIG. 13*b* shows the holder in an open position, in which automatic dumping of the weight 13 has just taken place.

In this embodiment, the holder 14 is positioned inside the pocket 13, at its upper end, and is fixedly connected to the pocket casing. A coupling mechanism 16 runs via a wall entrance in the casing, which coupling mechanism 16 is connected to the weight dumping device 15 by aid of which the holder 14 can be manually locked and manually or automatically initiate dumping of the weight.

Figure 14A:
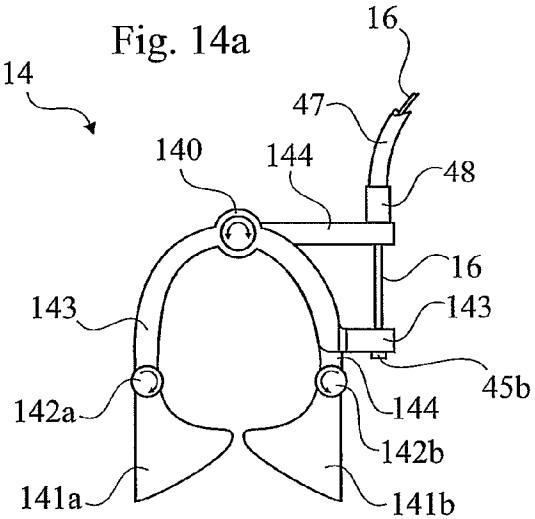
FIG. 14*a* shows a detailed side view of the holder 14.
Figure 14B:
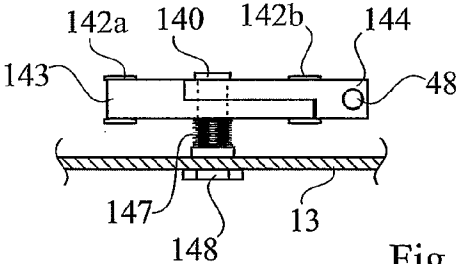
FIG. 14*b* shows a detailed top view of the holder 14.

FIG. 14*a* shows a detailed side view of the holder 14. The holder comprises two shackles 143, 144 that are pivotally arranged about a shaft 140. At one of its ends, the first shackle 143 is connected to a first spring-loaded claw clutch 141*a*, 142*a* and at its other end, the first shackle comprises an attachment 45*b* for the coupling mechanism 16, which in this case is a pressure cable. The second shackle 144 that differs in shape from the first shackle is at one of its ends connected to a second spring-loaded claw clutch 141*b*, 142*b* and at its other end the second shackle comprises an attachment 48 for a casing 47 for the pressure cable 16. The shackles are moreover affected by a resilient force from a spring 147 (shown in FIG. 14*b*) that affects the shackles by an opening force, i.e. the spring strives to turn the shackles in separate directions about the shaft, such that the claw clutches will release the attachment 120.

The figure shows the holder 14 in a locked position, which is clear from the fact that the coupling mechanism has been tensioned, whereby the ends of the shackles that comprise the attachment 45*b* for the coupling mechanism and the attachment 48 for the casing, respectively, are pulled in a direction towards each other. At the same time, the other ends that comprise the claw clutches move in a direction towards each other. As is clear from the figure, it is important that there is enough space at the side of the respective shackle, such that is can rotate outwards and release the weight. It is also realised that there must be enough space for the claw clutches to rotate outwards when the holder is in a locked position, in order to enable manual insertion and release of the weights, i.e. in the locked position shown in the figure.

14*b* shows a top view of the holder 14, Here, the shaft 140 about which the shackles 143, 144 are pivotally arranged, is seen. The holder is attached to the pocket 13 casing via the shaft. The figure also shows the spring 147 that affects the shackles by an opening force.

Figure 15A:
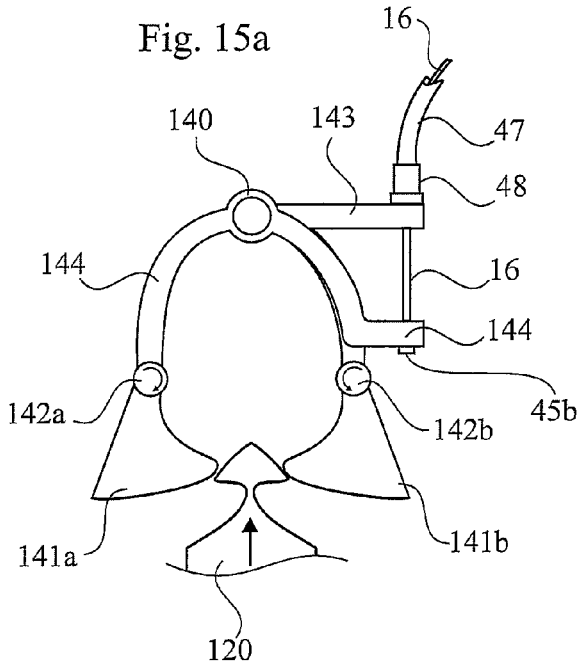
FIGS. 15*a-c* show the holder 14 in different positions in a side view.
Figure 15B:
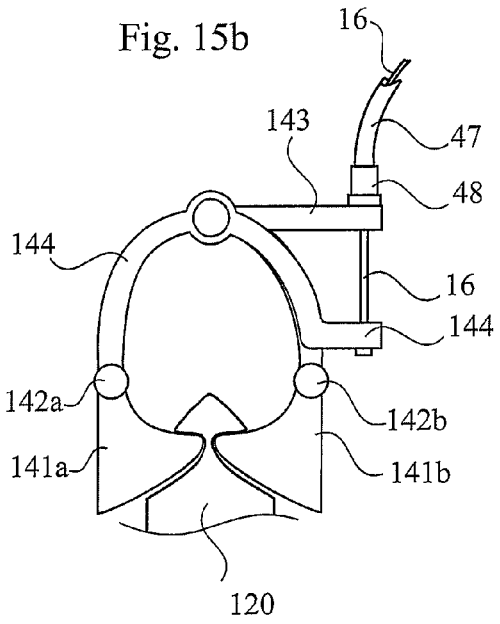
Figure 15C:
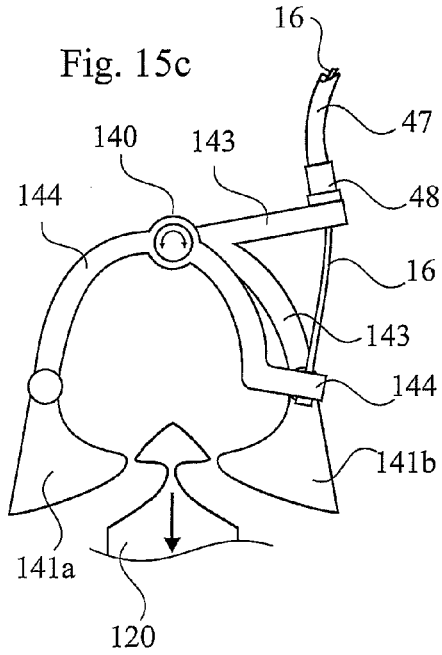

Referring to FIG. 15*a-c*, it will now be described how a weight is fastened in the holder and how automatic dumping of the weight will take place. In the locked position shown in FIG. 15*a*, the attachment 120 of the weight will press the claw clutches 141*a*, 141*b* apart as the weight is inserted in the pocket. As soon as the attachment has been brought up high enough in the attachment, the claw clutches will spring back towards each other and assume the position shown in FIG. 15*b*, in which position the weight is now held in place in the pocket. The spring force of the claw clutches is strong enough in order for the weights to stay in place even if they are exposed to reasonable downwards directed forces due to thoughtless moving of the diver or if the jacket is dropped to the ground in connection with handling. The spring force is however not greater than that the diver manages to release the weight by grabbing its handle 121 and pulling it downwards. As is realised, this is a very important functionality since it should always be possible to release the weights also in a conventional way. In case of an emergency, automatic dumping will be initiated. It should be realised that automatic dumping also can mean that the user himself, or some other person that comes to rescue, initiates the dumping via the dumping device 15. It is described in more detail how this takes place in connection with FIGS. 16*a-c*. Via the release mechanism 42, the force applied by the pressure cable 16 will let go and the spring 147 will instantaneously turn the shackles 143 and 144 apart such that the claw clutches will release their hold of the attachment 120, whereby the weight is allowed to fall from the pocket.

In order to prevent trash from risking to get stuck in the holder, thereby disturbing the function, the holder can be housed behind a wall (not shown) that separates the upper space of the pocket from the lower space that is intended to house the weight. A smaller opening may be arranged in the wall, allowing the attachment 120 to pass. The holder can also be enclosed in a casing that comprises a corresponding opening for the attachment. Naturally, the opening must be designed such that the attachment does not risk getting caught in the same, thereby preventing dumping of the weights. It is also possible to allow the wall to consist of soft bristles that efficiently will prevent trash from reaching the space around the holder but that will give way for the attachment. The wall may also consist of a flexible rubber sleeve that works in the same way. Yet an alternative is to house the holder in a space that encloses the pocket and to allow the claw clutches to act through the side walls of the pockets. In that case, the attachment 120 could be formed by grooves in the sides of the weights.

Figure 16A:
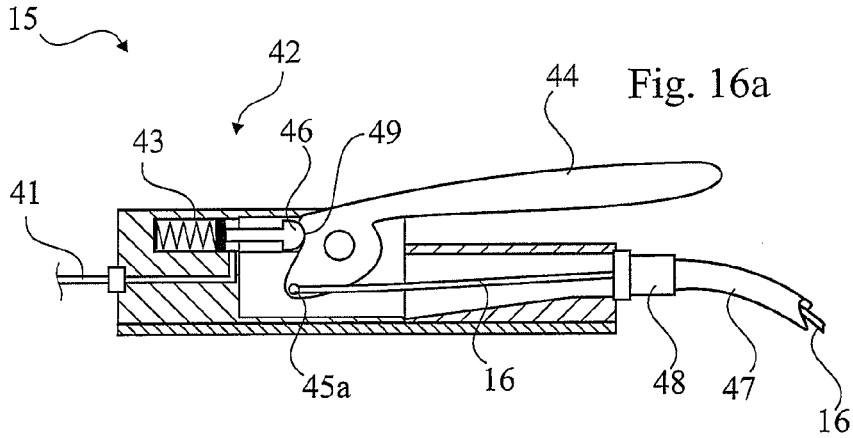
FIGS. 16*a-c* show the weight dumping device 15 in different positions in a side view.
Figure 16B:
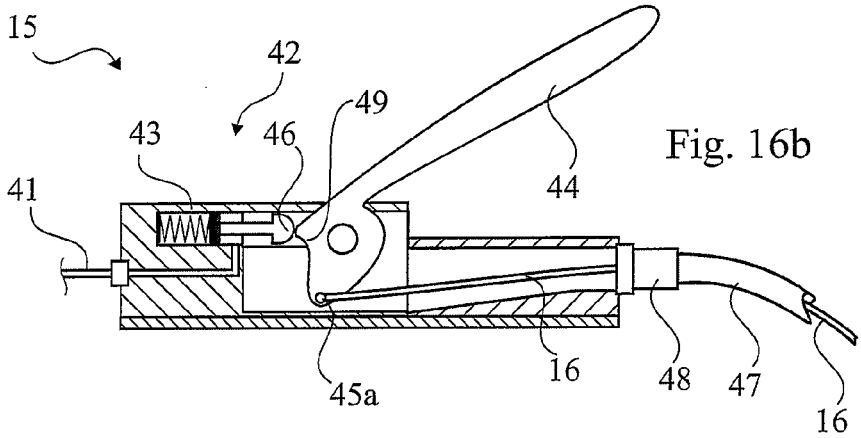
Figure 16C:
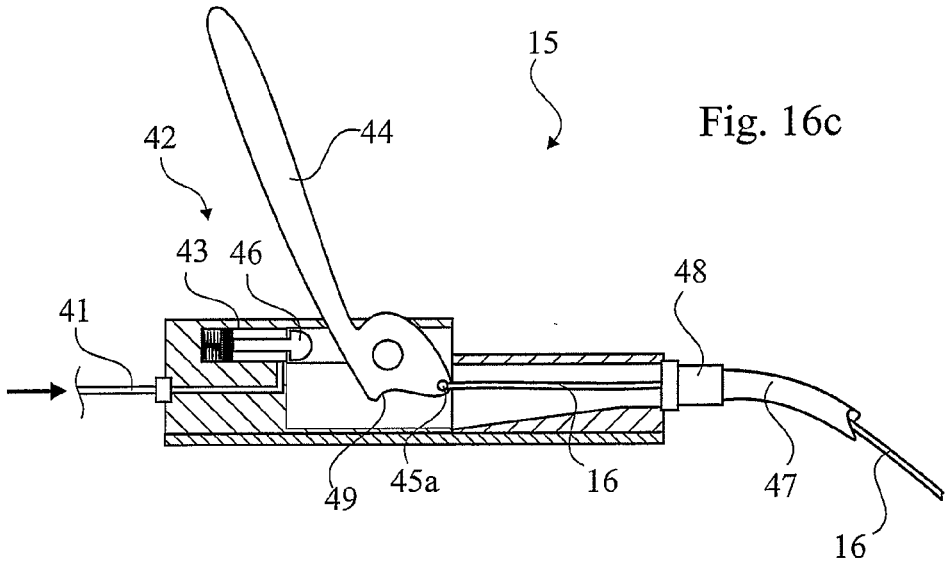

FIG. 16*a-c* shows a side view of a weight dumping device 15 that comprises a release mechanism 42. In FIG. 16*a* it is shown in a closed position, in FIG. 16*b* it is shown in a half-open position and in FIG. 16*c* it is shown in a completely open position that will lead to dumping of the weights from the diving jacket, in accordance with the description in connection with e.g. FIG. 6*a*, FIG. 7 and FIGS. 13 and 14. In FIG. 16*a-c*, the release mechanism 42 is partly schematically illustrated and shows a house inside which a handle 44 is pivotally arranged. One end of a coupling mechanism 16 is arranged at an inner end of the handle 45*a*, the purpose of which coupling mechanism 16 being to affect a holder 14 that is arranged to hold a weight 11 in place. In the present embodiment example, the coupling mechanism 16 is composed of a pressure cable 16 that extends to the holder 14 via a cable casing 47. In a manner that is known per se, the cable casing 47 is fixed by the release mechanism 42 to the house. In the opposite end, in relation to the cable connection 48, a sealed space 43 is arranged, inside which a spring-loaded piston 46 is arranged. The spring continuously affects the piston 46 by a force out from the space 43 and the end of the piston is arranged thereby to bear against a recess 49 at the handle 44, which locks the handle 44 in this closed position with the purpose of eliminating undesired activation of the release mechanism 42. The connection 41 from the coupling device 17 is furthermore connected at the same end of the house as said sealed space 43. This connection 41 mouths at the opposite side of the piston 46, in relation to the spring, such that at pressurisation via the connection 41, the piston 46 will be pushed into the sealed space 43 at the same time as the spring is compressed. In accordance with what is shown in FIG. 16*b*, the handle 44 will be released and start to rotate. FIG. 16*c* shows the final position in which the piston 46 has been completely pushed into the space 43 and the handle 44 has been turned up to its end position, whereby the holders 14 have opened and the weights have been released.

As soon as the air pressure via the connection 41 has stopped, the piston 46 will reassume its protruding position, by the spring pressing it out from the space 43 again. Thereafter, the handle 44 can once again be returned to its closed position, simply by being turned down, whereby the piston 46 will once again snap into the recess 49 and lock the handle 44. According to the preferred embodiment, the spring inside the space 43 is forceful enough to retain the handle in its locked position in order to prevent undesired release, but still soft enough to enable a diver by manual force to release the handle 44, i.e. turn the handle 44 and thereby press the piston 46 back against the spring force.

Figure 17:
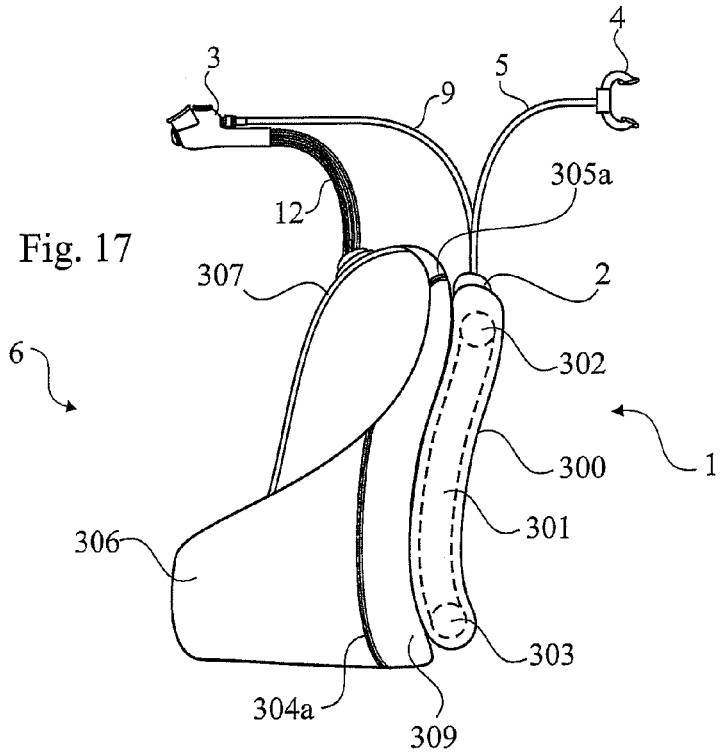
FIG. 17 shows a side view of diving jacket according to the invention, with a modified pressure tank.
Figure 18:
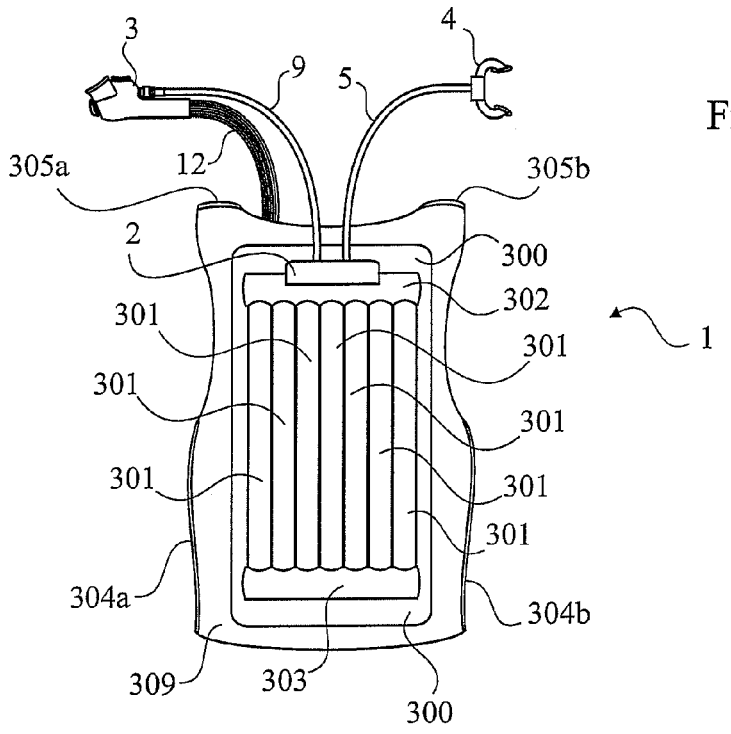
FIG. 18 shows a rear view of a diving jacket according to the invention, with a modified pressure tank.

FIG. 17 shows a side view of an embodiment of a diving jacket according to the invention, with a modified pressure tank. FIG. 18 shows the same type of diving jacket as seen from behind. It is clear from the figures that according to this preferable embodiment, the pressure tank 1 is shaped to form an ergonomically adapted part of the diving jacket 6. This is achieved by the pressure tank 1 consisting of a plurality of pressure cylinders/containers 301 that are arranged adjacent each other and extend in the vertical direction. At their ends, the vertically arranged cylinders/containers 301 are connected to an upper 302 and lower 303 cylinder/container, respectively, such that continuous communication is achieved between the containers/cylinders that form part of the pressure tank 301, 302, 303, but it is realised that the connection can be achieved in many ways. The cylinders/containers 301 may e.g. be connected to each other by a cylinder in the upper or lower end. A valve device 2 is arranged at a suitable position in relation to the tank package 1, the function of which is as described above, i.e. with at least a first connection 5 to the breathing regulator 4 and a second connection 9 to the inflator 3, respectively. As is clear from FIG. 17, the vertical containers/cylinders 301 are shaped to have an extension that fits the curving of the back of a user. The containers/cylinders 301 are preferably arranged in a plane the extension of which running essentially in parallel with the extension of the diver's back, i.e. with a slight shape of an S, as seen from the side. Furthermore, as is clear from FIG. 18, the pressure tank package 1 is arranged to have such a width that it does not extend outside the diver's back. It is also shown that the vertical cylinders/containers 301 are advantageously arranged in close abutment with each other in order to be able to hold as large air volume as possible within the limited area available that corresponds to the diver's back. Similarly, the containers/cylinders 301 are adapted in height such that the horizontal cylinders/containers 302/303 are accommodated within an area that is formed essentially from the back of a normal diver and in such a way that the horizontal cylinders 302, 303 are in close abutment with the ends, whereby a compact tank package 1 is achieved. It is realised that it is naturally conceivable instead to arrange the cylinders/containers 301 that are in close abutment with each other in the horizontal direction and arrange the cylinders 302/303 that interconnect them instead in a vertical direction. Preferably, each of these cylinders/containers 301, 302, 303 has an outer diameter D that is less than 100 mm, more preferably less than 80 mm.

Many aspects will influence the choice of material and dimensions for the cylinders/containers 301, 302, 303. One basic property for the choice is that the total volume formed in the package should be large enough to house the desired amount of air. Thanks to a larger width being achieved by such a package, preferably at least 400 mm, as compared to what a traditional pressure tank may offer, the package may have a "thickness" that makes it compact and holding enough volume. Naturally, another aspect is the cost, in connection with which it is suitable to seek materials and production methods that give a reasonable level. In this connection it is advantageous to use tubes existing on the market, such as stainless tubes, of suitable dimensions (e.g. 60 mm outer diameter), which will allow for a reasonable cost of comprised materials, which tubes are suitably joined together by welding, which is a cost-efficient method that allows for high strength/tightness. The material of the cylinders/containers 301, 302, 303 is suitably a material of relatively high density, such as stainless steel, with the purpose of creating weight in the tank package, which is advantageous in connection with diving. Many advantages are achieved by the pressure tank package according to the invention. Contrary to conventional pressure tanks that are bulky, a very compact assembly is achieved according to the invention, which will result in considerably much better clearance than previously possible. Accordingly, improved availability and thereby also improved safety is achieved for the diver. Furthermore, the design of the pressure tank 1 contributes to better streamlining, whereby not at least less energy is used when a diver moves in the water. An additional and very important advantage is that the centre of gravity is moved towards the diver's body. Hereby, the diver's stability will increase since when using conventional pressure tanks 1, the centre of gravity is very far away from the diver's back whereby it will affect the diver with a moment as soon as he turns to one side. This aspect too will hence lead to improved safety in connection with diving.

If desired, the tank package can be enclosed in an openable casing 300, thereby offering the opportunity to further improve the ergonomic aspects for the user. For example, the backside of the casing can be given a very figure-hugging shape with padding to give good pressure relief against the back. One conceivable possibility for very good comfort is to provide the backside with a type of material that can be shaped after the person's back by heating and that keeps the shape upon cooling, such as is known today for individual adapting of skates e.g.

The front side of the casing 300, i.e. the side that faces the surrounding water, can be given a shape that improves diving properties additionally, such as by a streamline shape that leads the water around the casing in such a way as to improve stability during diving. Advantageously, the casing can be open to the surrounding, such that the water may flow into the casing and surround the containers/cylinders 301, 302/303, whereby the centre of gravity close to the diver is maintained. By the use of a casing, easy switching of the tank package can be offered by the casing comprising some type of attachment means for the tank package. Suitably, these attachment means can be used for tank packages of different sizes, such that the diver is given the possibility to use a tank package that holds a suitable amount of air for the planned dive.

It is furthermore clear from FIGS. 17 and 18 that the pressure tank package 1 may constitute a separate part of a diving jacket 6. This is achieved by arranging the pressure tank 1 at a separate back piece 309 that is provided with connection means 304*a*, 304*b*, 305*a*, 305*b* that can be connected with the other parts 306, 307 that are comprised in a diving jacket 6. Hereby, the other parts 306, 307 preferably form a coherent unit per se, to which the back piece 309 can be attached, such as by aid of zip fasteners and/or Velcro® fastening and/or buckles.

According to an alternative embodiment, the other parts 306, 307 of the diving jacket 6 are formed by at least two separate units, the side pieces 306 and a front piece 307. Thanks to this system based on modules, a diver may in a flexible and variable way choose the component parts of his diving jacket 6, e.g. with the purpose of achieving different types of colour combinations, which could fulfil many purposes, such as colour combinations that provide fast/easy identification of divers in the group, aesthetically pleasing, indicating functionality, etc., and also have the positive effect of increasing the motivation of acquiring safer diving equipment. Moreover, the design enables for a partly damaged jacket to be repaired by exchange only of a limited part of the diving jacket 6. It is realised that this part of the invention is applicable without connection with the other parts of the inventive concept described above. It is in other words realised that the tank package 1 as such naturally can be used in connection with other existing sets of diving equipment and diving jackets, respectively, which are equipped with completely different types of valve devices than the above described and which also for the rest can be equipped with other types of equipment than the above described. In a corresponding manner, it is realised that the design based on modules, of a diving jacket as described above, can be used also in connection with other types of equipment than the above described, e.g. in combination with conventional pressure tanks, with or without valve devices according to the invention.

The person skilled in the art will realise that the invention should not be limited to the examples above, but the scope of the concept according to the invention comprises a large variety of elements and devices having the same functionality and being able to achieve the same purpose. It is realised for example that the actuator can be equipped with electronic sensors and regulators such as electronic pressure sensors, timing blocks, etc. It is realised for example that the breathing sensing means 21 can be composed of a variety of other devices than those described above. An obvious modification is to arrange some type of flow-sensing means in the flexible tube 5 or inside the breathing regulator 4, such as a mechanical device that indicates the emergence of a flow, e.g. a small impeller the rotation of which is detected in order to reset the delay means 22.

It is also realised that modifications in respect of the control and regulation functions of the actuator can be made within the scope of the invention. It may be desirable e.g. for an instructor in connection with training to be able to determine when the device should be activated and when not, and hence it is conceivable for the device to comprise means for remote actuation. This can be made such that the dive leader has a (small) computer unit with a display (e.g. a "Palm" or the like) that communicates with breathing sensing means arranged in connection with each breathing regulator 4, which means gives an alarm signal if a diver has not breathed in his regulator for a predetermined time period, whereby the dive leader, by aid of a remote actuation means (suitably the same unit that gives the alarm signal, e.g. the same Palm), can initiate the trigger valve 23 to open up in order for the diving jacket 6 of the equipment that gave the alarm signal (or all equipments) to inflate. Hence, it is realised that initiation of inflation of the diving jacket 6 and automatic dumping can take place in many other ways than those exemplified above.

It is also realised that the principles of the invention can be used also in connection with non conventional diving equipment, such as the case in which the diver employs a pressure tank only containing a small amount of air and that thereby doesn't need to be carried as a backpack but can be held by the diver's mouth such that no flexible tube is necessary between the pressure tank and the breathing regulator 4. Often, such a pressure tank 1 may contain an amount of air that is insufficient to secure inflation of the diving jacket 6. In that case, the diving jacket 6 can instead be provided with releasable ampoules that in connection with initiation will inflate the jacket with a suitable gas in order to provide sufficient buoyancy and preferably also will dump the weights. Of course, it is possible to use a combination of the last mentioned features, whereby the breathing regulator 4 is in electronic contact with an actuator 8 that is able to activate the interconnection from a conventional pressure tank 1, and/or ampoules according to the above. It is furthermore realised that the pressure sensing means coupled to the actuator need not be able to be mechanically affected, but instead an electronic pressure sensing means, e.g. in combination with a piezoelectric pressure sensor, can be used which controls the air supply to a valve mechanism with the same type of functionality as the diaphragm valve 21 described above. According to the same line of thought, it is realised that also the delay mechanism can be arranged to be completely electronic, for example by building in a timer function that fulfils the desired functionality, this too for example in combination with a piezo-electric pressure sensor. It is furthermore realised that many of these functions can be picked from dive computers existing today, accordingly enabling synergistic combinations. Another synergistic effect is that settings for e.g. the actuation zone, delay time, etc. are easy to change in a flexible manner. For training purposes it can also be desirable to provide a device that allows for testing the function on shore and accordingly it may be of interest to activate the device manually.

According to yet another aspect, it may be desirable to be able to increase the actuation zone, suitably coupled to some other conditions. An actuation zone that is deeper than the above given may in combination with a partial inflation of the diving jacket (which as such will result in a slow ascent to the surface) results in that the diver is transported to the surface instead of disappearing in the depth. Hereby, rescue operations can be performed in a considerably shorter time than what would otherwise be the case.

According to a modification of the invention, it can be used also to secure that persons who have drowned are brought to the surface, which is often a strong desire for the relatives. This can be achieved by coupling an additional function to said other functionalities, which function initiates triggering of the trigger valve 23 when a certain longer time period has elapsed, such as one hour, with the condition that breathing has not taken place in the breathing regulator 4 and suitably also with the condition that the pressure sensing means has not been exposed to a pressure corresponding to atmospheric pressure during this time period.

It is also within the scope of the invention to offer an automatic weight dumping function to divers that do not have a diving jacket according to the invention provided with pockets that offer this function. By arranging the pockets 13 on a belt or a harness, which is also arranged to comprise a coupling mechanism 16 and a weight dumping device 15, the diver can be offered this function. In that case, the weight dumping device is provided with pressurised air from the coupling device 17, via a separate flexible supply tube. In that case, the flexible supply tube is connected to the coupling device 17 via a special adapter that in principle is a mirror-image of the bottom piece 65 of the jacket coupling 60. The difference between this special adapter and the bottom piece 65 is that the connection 67 for pressurised air is led through the side of the adapter, to a coupling for the flexible tube 41.

This special adapter is connected to the conventional jacket coupling 60', between the latter and any one of an adapter 50 according to the invention and an inflator coupling 80 according to the invention.

It is also realised that the term connection may encompass a wide span of variation of actual embodiments, such as flexible tubes, channels that are moulded in the jacket or arranged in other ways, etc. It is also realised that many of the other mechanical components described above can be changed to other types of component variants that can offer the same function.

The invention claimed is:

1. A safety method in connection with SCUBA diving to control a divers buoyancy, in which method comprises:

equipping said diver with diving equipment comprising:

at least one air pressure tank;

a valve device connected to said pressure tank and arranged to supply air from said pressure tank via first supply means to a breathing regulator and via second supply means to enable automatic filling of an inflatable diving jacket; and an actuator being able to automatically initiate inflation of the diving jacket and, with the purpose of additionally improving the diver's buoyancy, also to automatically initiate dumping of a weight carried by the diver, wherein said actuator is activated when the diver has not affected the air flow through the breathing regulator for a certain time period, said actuator being controlled by an actuation mechanism that automatically sets the actuator in active mode when the diver is within an actuation zone, whereby said automatic dumping can take place, and in that there is also arranged a release mechanism that can be manually influenced and that comprises a handle connected to a mechanism the purpose of which is to influence a holder arranged to hold a weight, and said second supply means are used also to control the diver's buoyancy by manual influence of the filling of said diving jacket.

2. A safety method according to claim 1, wherein said actuation zone is defined by an upper actuation depth and a lower actuation depth.

3. A safety method according to claim 2, wherein the actuator comprises a pressure sensing means that detects the depth of the diver.

4. A safety method according to claim 3, wherein said diving jacket comprises a coupling device for supply of pressurized air from the pressure tank to the diving jacket, and in that said actuator is arranged at the diving equipment and comprises at least one mechanical valve device in fluid communication between the valve device and said coupling device.

5. A safety method according to claim 4, wherein the actuator comprises a trigger valve connected to said second supply means and controlled by a delay means, and breathing sensing means adapted to reset said delay means.

6. A safety method according to claim 5, wherein said delay means, in a trigger mode, opens up a trigger connection from the delay means to the trigger valve, whereby pressurized air from the valve device inflates the diving jacket, and affects a dumping device that is arranged to affect a holder to release said weight.

7. A safety device arranged to be connected to diving equipment comprising:

at least one air pressure tank;

a valve device connected to said pressure tank and arranged to supply air from said pressure tank via first supply means to a breathing regulator and via second supply means automatic inflation of a diving jacket comprising means for sensing breathing through said breathing regulator; and an actuator being arranged to automatically initiate said inflation of the diving jacket and to additionally improve the diver's buoyancy by automatically initiating dumping of a weight carried by the diver, wherein the actuator is arranged to be activated when the diver has not affected the air flow through the breathing regulator for a certain time period and in that said actuator is controlled by an actuation mechanism that automatically sets the actuator in active mode when the diver is within an actuation zone, whereby said automatic dumping can take place, and in that there is also arranged a release mechanism that can be manually influenced and that comprises a handle connected to a mechanism the purpose of which is to influence a holder arranged to hold said weight, and said second supply means are arranged to control the divers buoyancy by manually influenced filling of said diving jacket.

8. A safety device according to claim 7, wherein said supply means comprises a first connection, a second connection, a third connection and a fourth connection that are directly or indirectly connected to said valve device, and in that said actuator is arranged to communicate with said valve device to initiate inflation of the diving jacket and automatic dumping of said weight.

9. A safety device according to claim 7, wherein said inflatable diving jacket comprises a coupling device for supply of pressurized air from said pressure tank to the diving jacket, and at least one pocket arranged to accommodate said weight.

10. A safety device according to claim 9, wherein said coupling device comprises a coupling component that is connected with the diving jacket, which coupling device comprises a first passage arranged to supply air to the diving jacket to inflate the same, a second passage arranged to supply air to the diving jacket for automatic dumping of said weight, and in that said passages are mutually sealed in an air tight manner.

11. A safety device according to claim 10, wherein said coupling device also comprises an air supply device that comprises a first connection arranged to supply air to said first passage and a second connection arranged to supply air to said second passage, and in that said air supply device is provided with air from said actuator.

12. A safety device according to claim 7, characterized in an inflator arranged at said diving jacket, comprising means for manual supply of pressurized air to the diving jacket for inflation of the same, the inflator being supplied with air from said pressure tank, via said valve device through a connection and an air supply device that is connected with a coupling device on the diving jacket.

13. A safety device according to claim 12, wherein said supply device comprises a first connection arranged to supply air to the diving jacket for inflation, and a second connection arranged to supply air to the diving jacket to initiate dumping of a weight that the diver carries in a pocket intended therefore.

* * * * *